US005207415A

United States Patent [19]

Yamamoto et al.

[11] Patent Number: 5,207,415

[45] Date of Patent: May 4, 1993

[54] PAPER FEEDING DEVICE

[75] Inventors: Junichi Yamamoto, Hadano; Iwao Fujii, Sagamihara; Yutaka Maeda, Kanagawa, all of Japan

[73] Assignee: Minolta Camera Kabushiki Kaisha, Osaka, Japan

[21] Appl. No.: 640,078

[22] Filed: Jan. 11, 1991

[30] Foreign Application Priority Data

Jan. 17, 1990 [JP] Japan ..... 2-9269
Feb. 5, 1990 [JP] Japan ..... 2-10455[U]
Jun. 6, 1990 [JP] Japan ..... 2-146101

[51] Int. Cl.[5] ..... B65H 3/08

[52] U.S. Cl. ..... 271/11; 271/104; 271/106; 271/107

[58] Field of Search ..... 271/5, 11, 15, 104, 271/106, 107

[56] References Cited

U.S. PATENT DOCUMENTS 1,296,690 3/1919 Novick ..... 271/106
4,369,962 1/1983 Spiro ..... 271/107 X
4,484,735 11/1984 Goi ..... 271/107 X
4,968,019 11/1990 Tanabe ..... 271/106
5,005,818 4/1991 Hayashi ..... 271/107

FOREIGN PATENT DOCUMENTS 56-18492 4/1981 Japan .
59-40357 11/1984 Japan .
1-256431 10/1989 Japan .
331435 7/1930 United Kingdom ..... 271/107

*Primary Examiner*—Richard A. Schacher
*Attorney, Agent, or Firm*—Willian Brinks Olds Hofer Gilson & Lione

[57] ABSTRACT

A paper feeding device which extracts from a cassette accommodating a stack of sheets such sheets one at a time and feeds them to the next step, namely an image forming part, comprises an attracting member capable of being moved between an attracting position at which the attracting member attracts a sheet from within the cassette and a feeding position which lies above the attracting position, a pressing roller capable of being moved between a position of retraction and the feeding position, and a rotary roller capable of cooperating with the pressing roller in nipping the sheet at the feeding position. The pressing roller moves to the feeding position after the elapse of a prescribed time following the completion of the motion of the sheet by the attracting member to the feeding position. The rotary roller is rotatably set in place at the feeding position. The rotary roller may be attached to the attracting member in such a manner as to be moved vertically in both directions in conjunction with the attracting member. When the leading end of the sheet being conveyed by the attracting member from the attracting position to the feeding position comes into contact with the pressing roller held at the position of retraction, the pressing roller acts upon the sheet in the direction of returning the sheet to the cassette.

15 Claims, 23 Drawing Sheets

FIG 3
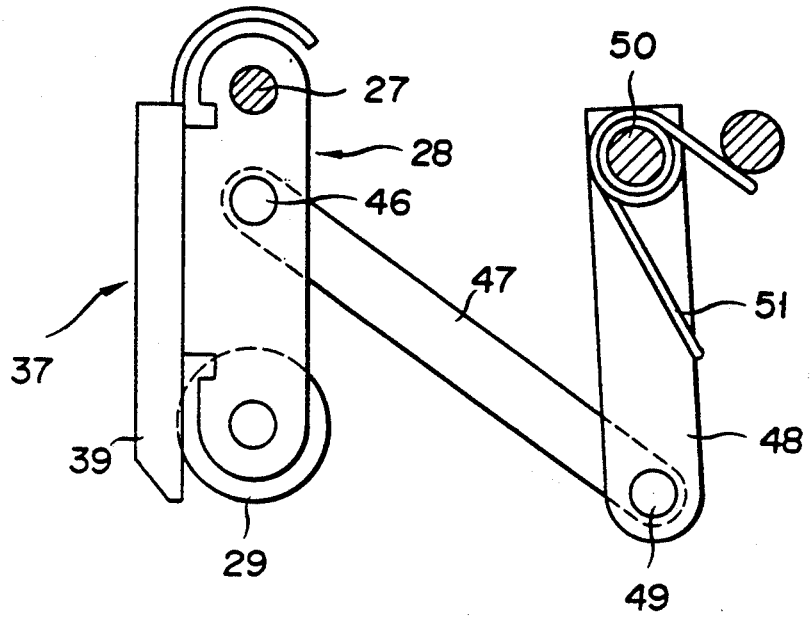
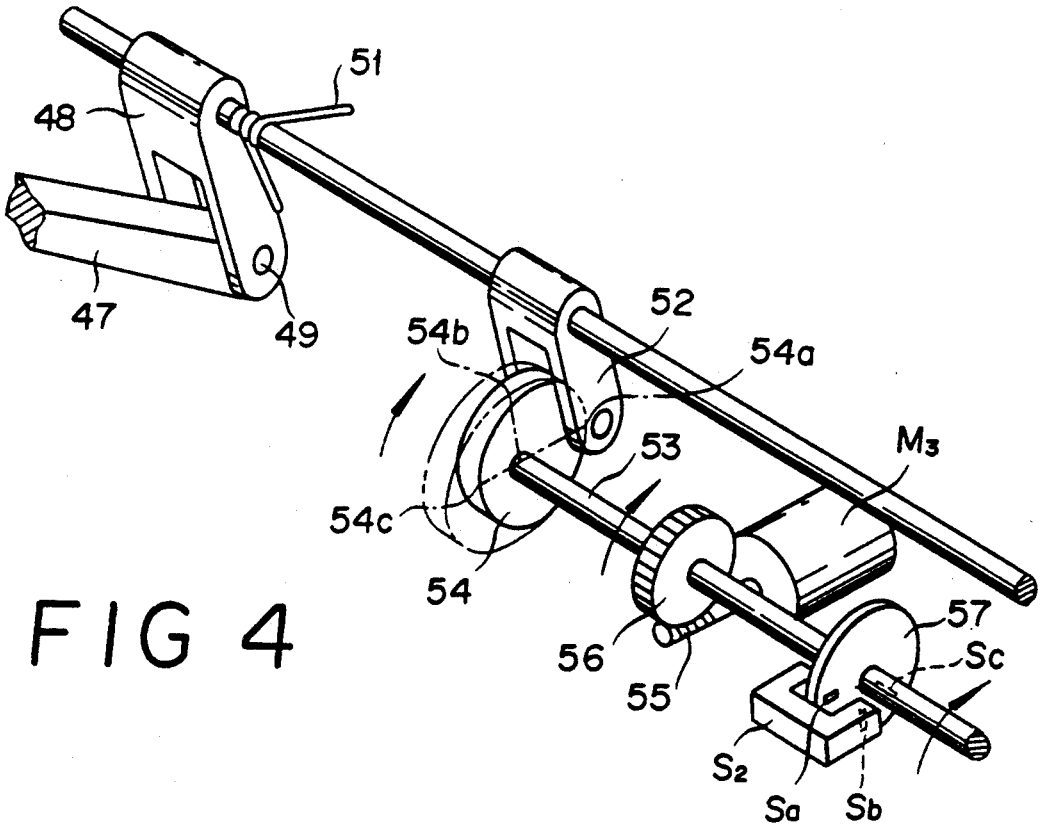
FIG 4

PAPER FEEDING DEVICE

BACKGROUND OF THE INVENTION

1. Field of the Invention

This invention relates to a paper feeding device to be incorporated in an image producing apparatus such as a thermal ink transfer recording system and adapted to convey a sheet material to an image forming part installed inside the image producing apparatus.

2. Description of the Prior Art

In an image producing apparatus such as a thermal ink transfer recording system, from a paper feeding cassette accommodating therein a pile of sheet materials or recording papers, the recording papers are played out one by one and conveyed in the direction of an image forming part installed inside the image producing apparatus. For the extraction of the recording papers from the paper feeding cassette, the practice of vertically reciprocating a vacuum pad relative to the pile of recording papers thereby generating a negative pressure and effecting the paper feeding by making use of this negative pressure as disclosed in Japanese Patent Laid-Open 1-256431, for example, has been conventionally employed if not invariably.

In the conventional technique of this nature, if the vacuum cup accidentally aspirates a plurality of sheet materials coherently at a stroke, the plurality of sheet materials in their coherent state are conveyed to the image forming part.

Japanese Patent Publication 56-18,492 discloses a paper feeding device. In this paper feeding device, a copying paper pulled up from the paper feeding cassette by the action of aspirating power is conveyed by the cooperation of a rotary roller and a pressing roller moved freely into and out of contact with the rotary roller. When a need arises to return a copying paper already extracted from the paper feeding cassette, this return of the copying paper cannot be attained by the paper feeding device under present discussion. This is because the thermal ink transfer recording system adapted to reproduce color images on a recording paper uses an ink film having inks of the three colors, e.g. yellow, magenta, and cyan, applied thereto and prints the color images sequentially superposed in the order of the colors mentioned above on the recording paper and, for the purpose of causing the color images of the second and third colors to be superposed and printed, requires the aforementioned return of the recording paper but encounters the misfortune that owing to the motion of this return, the recording paper inevitably interferes with a part serving the purpose of discharging a recording paper from the paper feeding cassette. Once this interference occurs, it entails misregistration of prints during the formation of color images and prevents images of high quality to be reproduced on the recording paper.

A primary object of this invention is to provide a paper feeding device which is designed to extract a recording sheet from a container accommodating a pile of such recording sheets and supply it to an image forming part and further adapted to preclude conveyance of a plurality of recording sheets in a coherent state.

Another object of this invention is to provide a paper feeding device which is provided with a sucker free to move vertically in both directions for extracting a recording sheet from the container and a first roller and a second roller jointly adapted to be paired so as to nip the recording sheet at the upper reach of the sucker and, therefore, is enabled to convey the recording sheet to an image forming part by means of the rollers.

Yet another object of this invention is to provide a small paper feeding device which is adapted to prevent the rollers and the recording sheet from interfering with each other when the recording sheet is returned to the position above the container in preparation for the superposition of a plurality of color images one after another on the recording sheet.

Still another object of this invention is to provide a paper feeding device which is so adapted that the outer peripheral surface of a roller contacts the leading end surface of a recording sheet being extracted from the container by the sucker and, when a plurality of recording sheets are coherently extracted, bends and separates asunder the coherent recording sheets and effects the return of the underlying recording sheets to the container.

A further object of this invention is to provide a paper feeding device which is so adapted that the roller for contact with the recording sheet being extracted from the container is rotated in the direction of advancing the recording sheet toward the container and causing a plurality of coherent recording sheets to be separated asunder A further object of this invention is to provide a small paper feeding device which comprises a roller performing the function of separating asunder a plurality of coherent recording sheets in addition to the function of conveying the recording sheet to the image forming part.

A further object of this invention is to provide a paper feeding device which is so adapted that the cooperation of the sucker and the roller imparts a bend to the recording sheet raised to the position of the upper reach of the sucker and, even when a plurality of recording sheets are coherently raised by suction, effects the return of the underlying unnecessary recording sheets.

A further object of this invention is to provide a paper feeding device which is so adapted that the second roller is advanced into contact with the first roller after the elapse of a prescribed time following the arrival of the sucker dragging the recording sheet at the upper reach thereof and the cooperation of the two rollers causes the unnecessary recording sheets extracted by the sucker to fall infallibly into the container.

A further object of this invention is to provide a paper feeding device which is provided with a lever for causing the unnecessary recording sheets falling from the sucker to be returned to the container.

A further object of this invention is to provide a paper feeding device which is provided with a container possessing a step at the position opposite the sucker so that when the sucker contacts the recording sheet inside the container, the recording sheet is bent and the sucker is consequently allowed to contact the recording sheet without fail.

A further object of this invention is to provide a paper feeding device which is so adapted that the sucker and the first roller are jointly moved vertically in both directions.

In accordance with the present invention there is provided, a paper feeding device, comprising a sheet holding part for accommodating a stack of sheets an attracting member for attracting said sheets one at a time a first supporting member for supporting said attracting member so as to allow motion thereof to an attracting position and a feeding position, said attracting position representing a position at which said attracting member collides with the uppermost of the sheets accommodated in said sheet holding part and said feeding position representing a position which lies above said attracting position and, at the same time, issues said sheets to the next step a rotary member capable of moving between a first position at which said rotary member collides with the leading end of said sheet attracted by said attracting member and moved from said attracting position to said feeding position and a second position at which said rotary member collides with the lower surface of said sheet having been moved to said feeding position, and a second supporting member for rotatably supporting said rotary member.

BRIEF DESCRIPTION OF THE DRAWINGS

FIG. 3 is a magnified lateral view illustrating the roller holder;

FIG. 4 is a perspective view illustrating a driving mechanism for shaking the roller holder:

DESCRIPTION OF THE PREFERRED EMBODIMENTS

Now, the present invention will be described in detail below with reference to working examples of this invention.

Figures 1A, 1B:
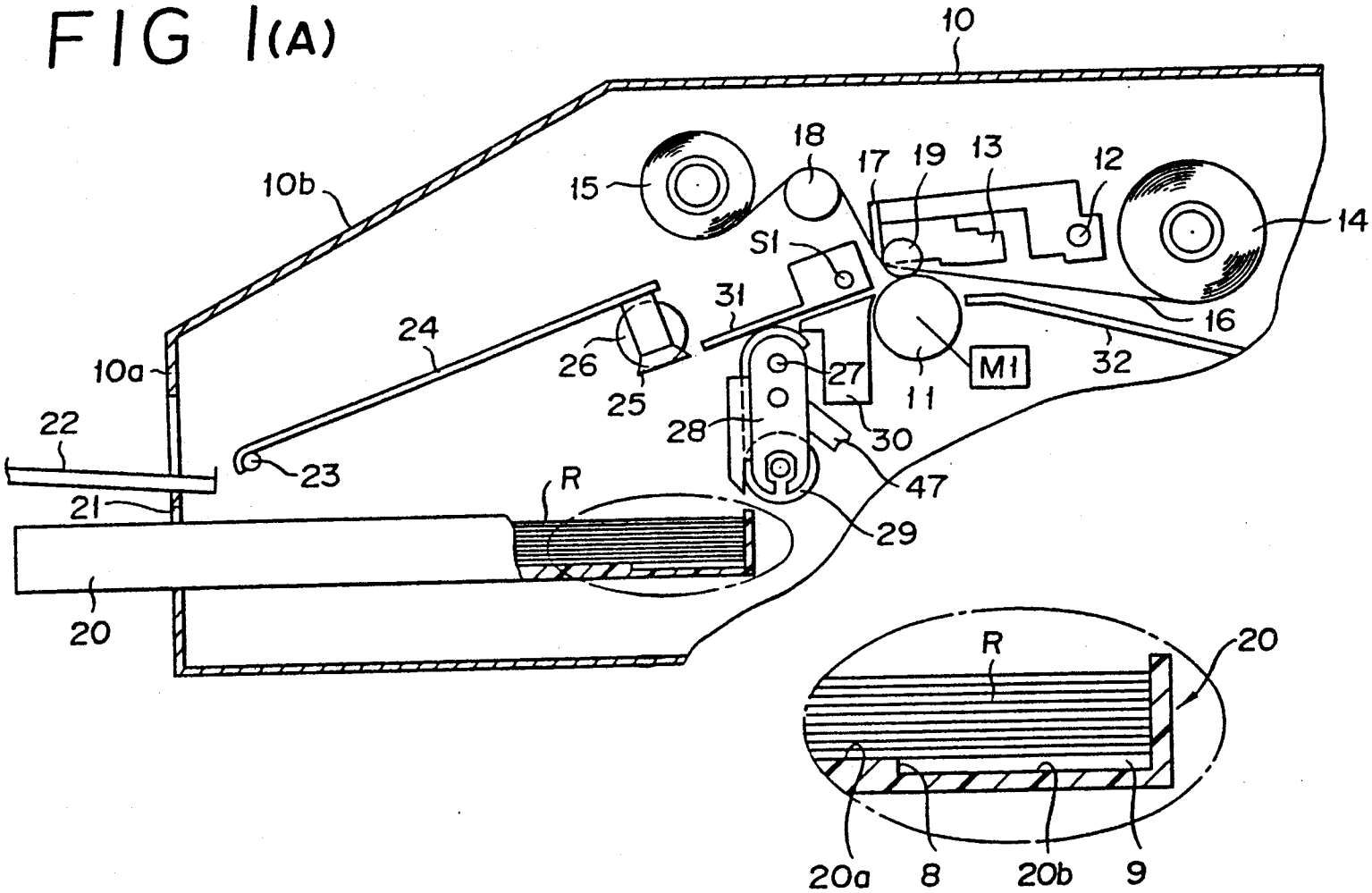
FIG. 1 is a lateral cross section illustrating the inner construction of a thermal ink transfer recording system incorporating therein a paper feeding device of this invention.

FIG. 1 is a lateral cross section illustrating the essential part of a thermal ink transfer recording system incorporating therein a paper feeding device. Inside a housing 10 of the device, a platen roller 11 is set in place so as to be freely rotated by a platen motor M1 and a thermal head 13 adapted to be freely shaken around a supporting shaft 12 is allowed to make and break contact with the platen roller 11. The thermal head 13 and the platen roller 11 make up an image forming part in the thermal link transfer recording system. Through the space intervening between the thermal head 13 and the platen roller 11, an ink film 16 played out from a feeding roll 14 and taken up on a takeup roll 15 is conveyed. These rolls 14 and 15 are freely attachable to and detachable from the housing 10. To the ink film 16 illustrated in the diagram, inks of the three colors, e.g. yellow, magenta, and cyan, are applied in the order mentioned.

The driving motion imparted to the takeup roll 15 causes the ink film 16 to be guided jointly by a peeling member 17 fixed at the leading end of the thermal head 13 and a film winding roller 18 and eventually taken up on the takeup roll 15. The platen roller 11 has a length equalling the width of the ink film 16. To the opposite end parts of the platen roller 11, paper nipping rollers (not shown) are integrally attached one each. A paper retaining roller 19, as illustrated, is adapted to be brought into pressed contact with the paper nipping rollers. When the platen roller 11 is set into motion to effect the formation of an image and the paper nipping roller which is integrated therewith is consequently rotated, therefore, the sheet material or the recording paper R is conveyed forward or rearward as nipped between the paper nipping roller and the paper retaining roller 19. The recording paper R, therefore, is given a width larger than the width of the ink film 16. During the conveyance of the recording paper R by the rotation of the platen roller 11, the paper retaining roller 19 prevents the recording paper from otherwise possible deviation. The paper retaining roller 19 may be adapted so as to be brought into pressed contact with the paper nipping roller at prescribed intervals.

Inside the housing 10, a paper feeding cassette 20 for accommodating sheets or the recording papers R in a piled state is set in place freely detachably through an opening 21 formed in a front wall 10*a* of the housing 10. The part of the front wall 10*a* directly above the opening 21 is adapted to permit attachment thereto of a discharged paper tray 22 for holding recording papers having an image already formed thereon. In the illustrated thermal ink transfer recording system, therefore, the keys of an operating panel part (not shown) disposed on a slanted wall 10*b* continuing into the front wall 10*a* of the housing 10 can be manipulated by an operator seated on the front side of the system. The work of taking out the paper feeding cassette 20, the work of setting it in place, and the work of taking out used recording papers can be performed on the front side of the housing 10.

As the recording papers or recording sheets R, i.e. a recording medium to be stored in the cassette 20, such sheet materials as plain papers, synthetic papers, photosensitive films, and OHP (overhead projector) grade transparent films, for example, may be used.

For the recording papers R held inside the cassette 20 to be taken out one by one, a shaking member or a paper feeding plate 24 is attached to a supporting shaft 23 in such a manner as to be freely shaken around the supporting shaft 23. This paper feeding plate 24 is provided at the leading end thereof with a vacuum cup or a sucking disk 25 for attracting the recording paper R by virtue of vacuum. When the leading end of the paper feeding plate 24 is returned to the upper reach thereof as illustrated in FIG. 1 after the paper feeding plate 24 is revolved until the vacuum cup 25 contacts the recording paper R and the vacuum cup 25 attracts one recording paper R by vacuum, the leading end of the recording paper R is raised to a prescribed position. At this prescribed position, a rotary roller 26 is rotatably set by means of a bracket 33 which will be specifically described herein below. A roller holder 28 attached shakably to a fulcrum 27 is provided at the leading end thereof with a driving side pressing roller 29 destined to nip and convey the recording paper R in cooperation with the rotary roller 26. The position of the outer peripheral surface of the pressing roller 29 and that of the roller holder 28 are fixed so that the pressing roller 29 contacts the leading end of the recording paper R while the roller holder 28 is kept at the position shown in FIG. 1 and the vacuum cup 25 attracts the recording paper R by vacuum and raises the leading end of the recording paper R. As a result, the leading end of the recording paper R collides with the outer peripheral surface of the pressing roller 29. This collision is capable of separating a plurality of cohering recording papers asunder.

In the leading end part of the paper feeding cassette 20, a bottom surface 20*b* lower by a step 8 than a bottom surface 20*a* of the main body part is formed as illustrated in FIG. 1 so as to give rise to a gap 9 between the lowermost recording paper R and the bottom surface 20*b*. This setup ensures ample fastness of adhesion of the vacuum cup 25 to the recording paper R.

The recording paper R the leading end part of which is raised by the vacuum cup 25 is nipped between the pressing roller 29 and the rotary roller 26 and conveyed forward to the right in the bearings illustrated in the diagram in consequence of the clockwise rotation of the roller holder 28. To guide the recording paper which is being conveyed forward as nipped between the pressing roller 29 and the rotary roller 26, a lower guide member 30 is set in place between the platen roller 11 and the roller holder 28 and an upper guide member 31 is disposed above the lower guide member 30.

The printing of an image on the recording paper R, in the illustrated case, is effected while the recording paper R is being returned after it has been conveyed to the position of its forward reach. To guide the recording paper R while it is being conveyed to the position of its forward reach after passage through the platen roller 11, a guide plate 32 is set in place on the right of the platen roller 11. To the upper guide member 31 is fixed a paper sensor S1 formed of a photosensor.

Figure 2:
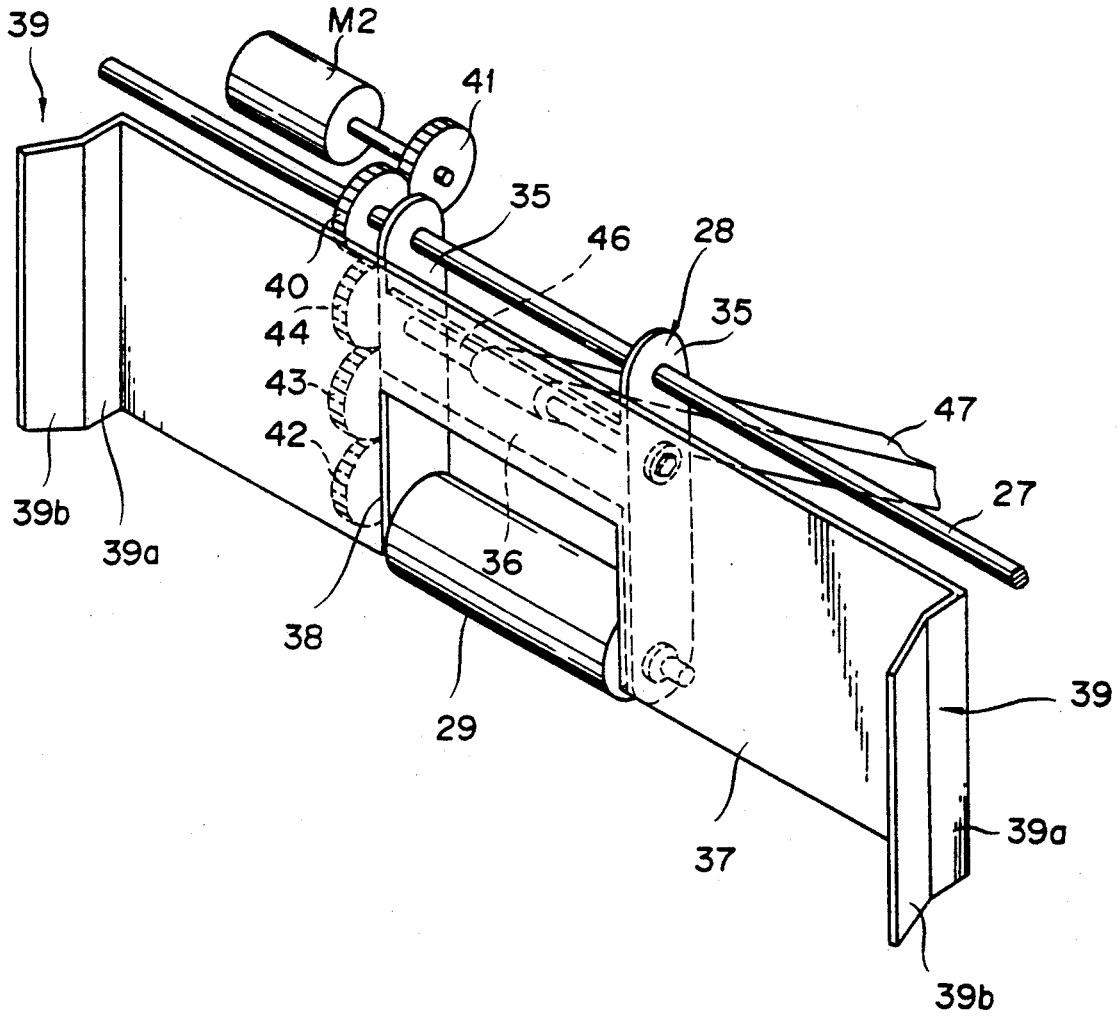
FIG. 2 is a magnified prospective view illustrating a roller holder shown in FIG. 1.

FIG. 2 is a diagram illustrating the roller holder 28 in detail. The roller holder 28 comprises two link parts 35 separated by a prescribed distance from each other and set rotatably on the supporting shaft 27 and a connecting part 36 interconnecting the link parts 35. The aforementioned pressing roller 29 is rotatably attached to the leading ends of these two link parts 35. To the roller holder 28, a guide plate 37 is fastened in the part thereof corresponding to the connecting part 36. The length of this guide plate 37 roughly equals the width of the recording paper. The guide plate 37 has a cutaway part 38 formed on the inner surface side thereof to expose the pressing roller 29. The guide plate 37 is provided at each of the opposite end parts thereof with a width regulating part 39 comprising a right angle part 39*a* perpendicular to the main body part of the guide plate 37 and a tapering part 39*b* bent outward from the leading end of the right angle part 39*a*.

To rotate the pressing roller 29, a driving toothed wheel 40 rotatably set on the aforementioned supporting shaft 27 is meshed with a toothed wheel 41 attached to the shaft of a conveying motor M2 and, at the same time, the driving toothed wheel 40 is meshed with a toothed wheel 42 connected to the pressing roller 29 through the medium of two idle toothed wheels 43 and 44. The position for disposing the conveyomg motor M2 may be selected arbitrarily. For example, the motor M2 may be so adapted as to rotate directly the supporting shaft 27 by delivering its own motion to the end part of the supporting shaft 27 and transmit indirectly the rotation of the supporting shaft 27 to the pressing roller 29.

To shake the roller holder 28, one end part of a raising member 47 is connected to a connecting pin 46 attached to the link part 35 and the other end part thereof is connected with a pin 49 to the lower end part of a shaking member 48 illustrated in FIG. 3 and FIG. 4. This shaking member 48 is fixed in the upper end part thereof to a supporting shaft 50. To this supporting shaft 50 is attached a torsion coil spring 51. This spring 51 imparts to the shaking member 48 the resilient force exerted in the clockwise direction in the bearings of FIG. 3. This resilient force urges the roller holder 28 in the clockwise direction in the bearings of the diagram, i.e. the direction of driving the pressing roller 29 toward the rotary roller 26.

The supporting shaft 50 is rotatably set in place inside the housing 10. On this supporting shaft 50, a driving member 52 is fixed as illustrated in FIG. 4. On a rotary shaft 53 adapted to be freely rotated parallelly to the supporting shaft 50, a cam 54 which the driving member 52 contacts is fixed. To rotate this cam 54, a worm gear 55 attached to the main shaft of a cam driving motor M3 is meshed with a worm wheel 56 fixed on the rotary shaft 53. To detect the angle of rotation of the cam 54, a disk or an encoder 57 is fixed on the rotary shaft 53. In this encoder 57, three slits Sa to Sc are formed as separated with a prescribed interval. The positions of these slits are detected by a rotary angle sensor S2 comprising a light emitting element and a light receiving element.

The rotary roller 26 is rotatably attached as illustrated in FIG. 5 to the bracket 33 attached to a fixing member (not shown). For the paper feeding plate 24 to be shaken to this position without interfering with the rotary roller 26, the paper feeding plate 24 has the cutaway part 34 formed therein. As a result, the rotary roller 26 protrudes past the lower surface of the paper feeding when the paper feeding plate 24 is shaken to the position of the upper reach of the vacuum cup 25. Two such vacuum cups 25 are disposed on the paper feeding plate 24 so as to attract the opposite lateral parts of the recording paper R. The shaking position of the paper feeding plate 24 is set so that when the vacuum cup 25 assumes the position of its upper reach, the sucking surface of the vacuum cup 25 reaches the position retracted by the step D from the lower side of the outer peripheral surface of the rotary roller 26. This step D is given a size of about 5 mm, for example. When the vacuum cup 25 having attracted the recording paper R by vacuum is moved to the upper reach thereof, the opposite lateral parts of the recording paper R is bent upward past the central part thereof. When a plurality of cohering recording papers R are attracted by vacuum and raised to this position, therefore, they are infallibly separated asunder. The vacuum cup 25, as illustrated in FIG. 5, is connected to a suction pump P with a hose 25*a*.

Figure 5A:
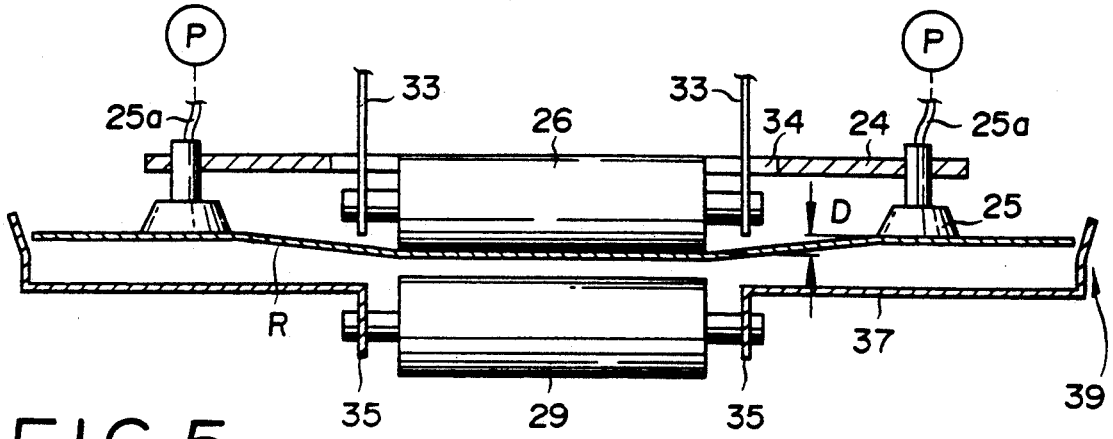
FIG. 5A to FIG. 5C are front cross sections illustrating a rotary roller and a pressing roller in the process of receiving a recording paper from a vacuum cup and delivering it to a guide plate.
Figure 5B:
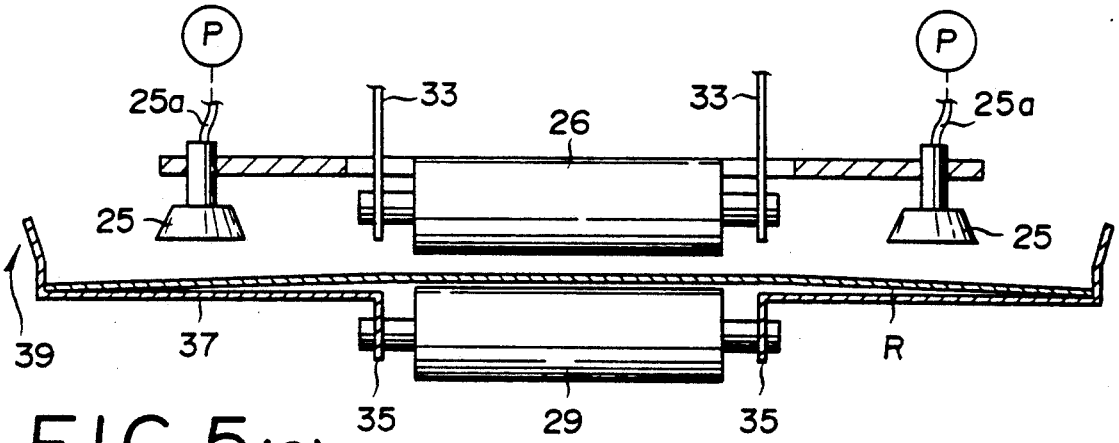
Figure 5C:
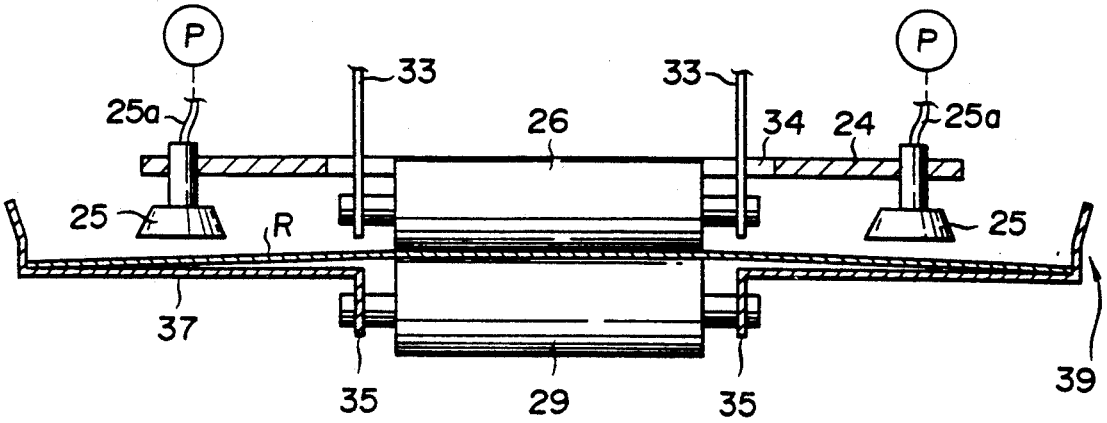
Figure 6:
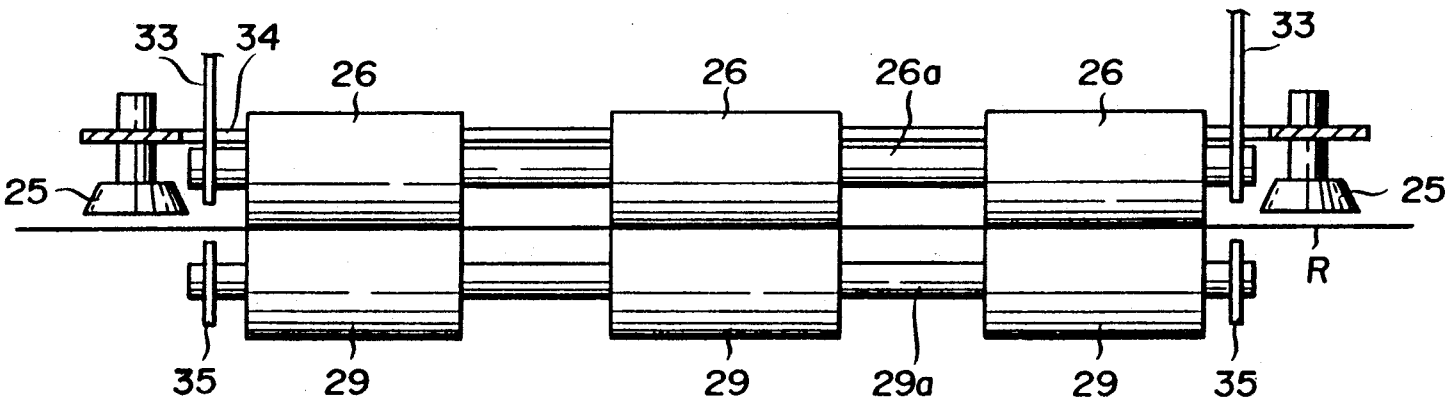
FIG. 6 is a cross section illustrating a rotary roller and a pressing roller each of another type.

FIG. 6 is a diagram illustrating the part of a paper feeding device of another type corresponding to the paper feeding device of FIG. 5. In this case, three rotary rollers 26 are attached to the rotary shaft 26*a* which is rotatably attached to the bracket 33. These rotary rollers 26 are linearly arranged as separated by a prescribed interval in the direction of width of the recording paper R. To the rotary shaft 29*a* which is rotatably attached to the link parts 35, three pressing rollers 29 are attached as opposed to the rotary rollers 26. These rollers 29 are severally paired with the pressing rollers 26. In this case, the recording paper R is nipped along the part of an ample length in the direction of width by the plurality of pairs of rollers. Thus, even when the use of the guide plate 37 is omitted, the possibility of the recording paper R sagging down after the recording paper R is relieved of the suction of the vacuum cup 25.

The rotary roller 26 and the pressing roller 29 may be substituted with rotating members and driven by means of a belt.

Figure 7:
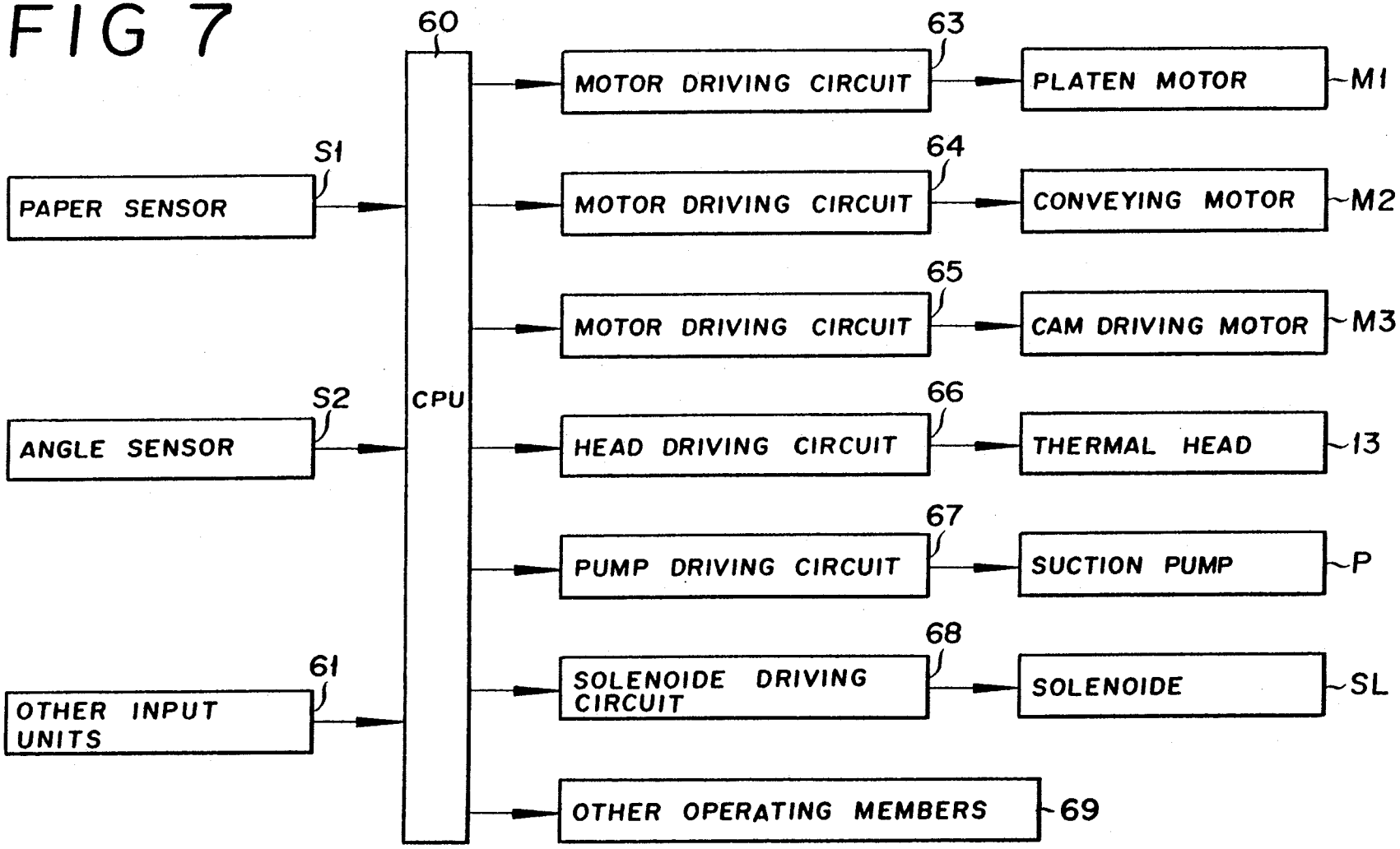
FIG. 7 is a block diagram illustrating a control circuit for the paper feeding device.

FIG. 7 is a block diagram illustrating a control part of the aforementioned thermal ink transfer recording device. A central processing unit (CPU) 60 is adapted to admit signals from the paper sensor S1 disposed on the upper guide member 31, the angle sensor S2, and other input units 61. The CPU 60 transmits control signals to the platen motor M1 for rotating the platen roller 11 in the normal and reverse directions, the conveying motor M2 for driving the pressing roller 29 in the normal and reverse directions, and the cam driving motor M3 for rotating the cam 54 in the direction indicated by an arrow in FIG. 4 respectively through the medium of driving circuits 63 to 65 and also transmits control signals to a head driving circuit 66 for delivering image data to the thermal head 13, a pump driving circuit 67 for delivering a drive signal to a suction pump P serving the purpose of supplying negative pressure to the vacuum cup 25, and other operating members 69 such as the film driving mechanism for driving the takeup roll 15 and consequently conveying the ink film 16.

Figure 12:
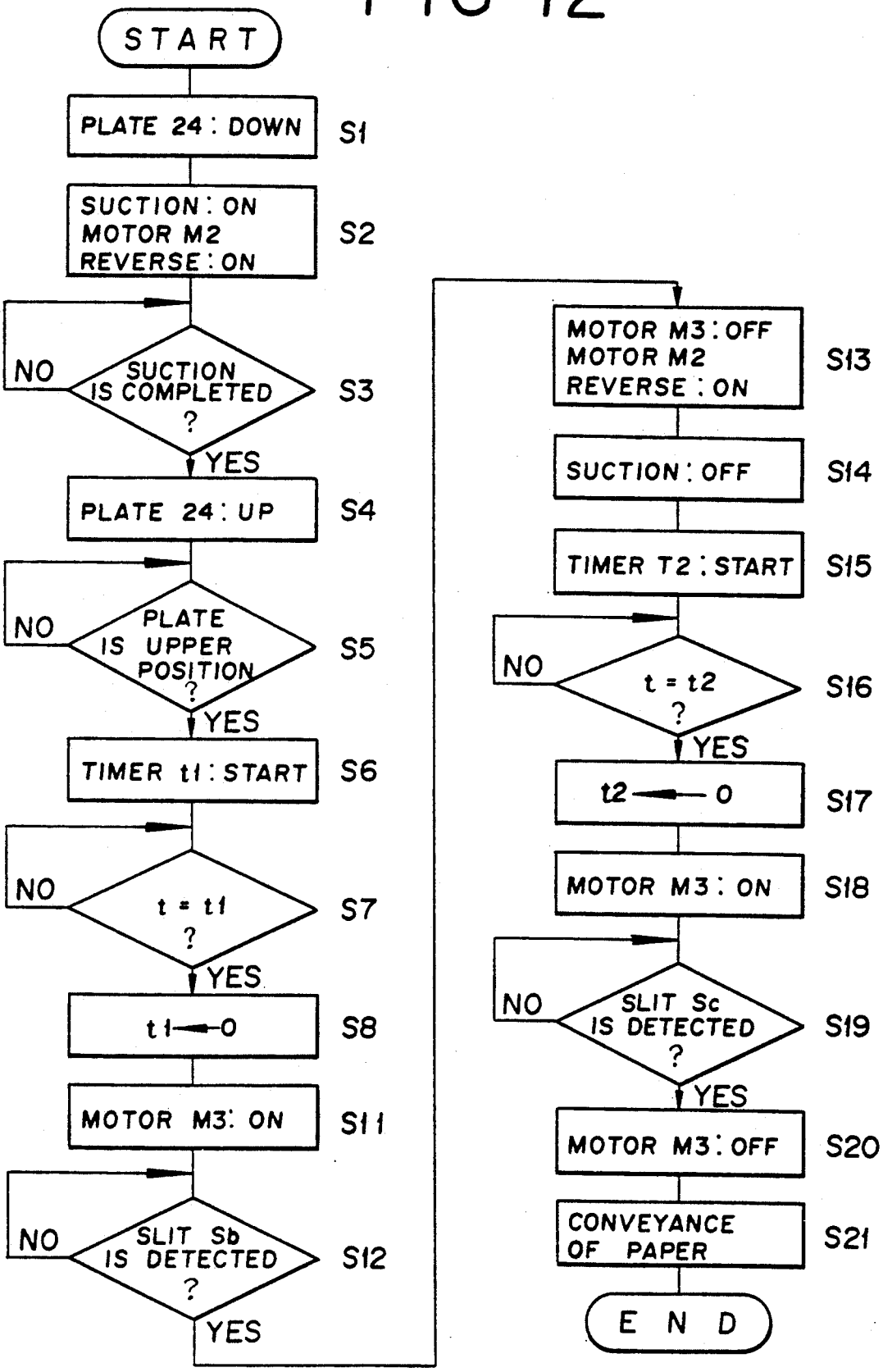
FIG. 12 is a flow chart representing the procedure of paper feeding followed by the paper feeding device of FIG. 1.

Now, the procedure for feeding the recording paper by the use of the aforementioned paper feeding device will be described below with reference to FIG. 8 and FIG. 12.

Figure 8A:
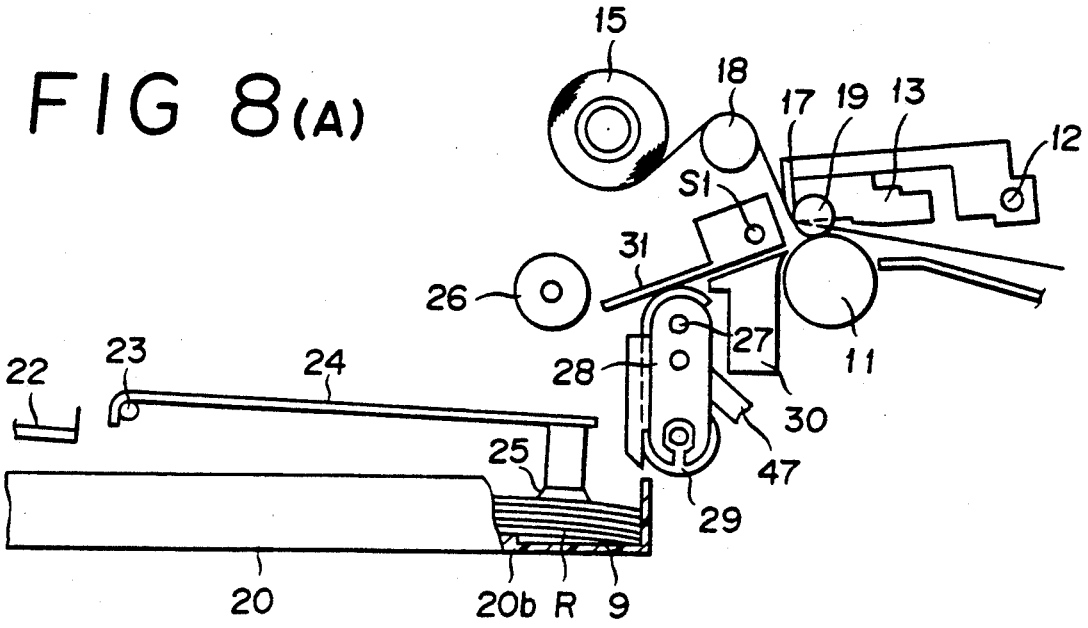
FIG. 8A to FIG. 8D are lateral cross sections illustrating a series of states of operation of the paper feeding device shown in FIG. 1.

Prior to the start of the paper feeding operation, the paper feeding plate 24 has shaken to the position representing the upper reach of the vacuum cup 25 as illustrated in FIG. 1 and the roller holder 28 has parted from the lower side of the rotary roller 26. At this time, the slit Sa for the initial position of the encoder 57 is located at the position of the angle sensor S2 and the driving member 52 is kept in contact with the initial position 54*a* of the cam 54. When the instruction to start paper feeding is issued in the ensuant state of the device, the paper feeding plate 24 is shaken in the clockwise direction in the illustrated bearings and lowered at Step S1 illustrated in FIG. 12. At Step S2, the motor M2 for rotating the pressing roller 29 is set into reverse rotation to rotate the pressing roller in the counterclockwise direction in the illustrated bearings and, at the same time, actuate the suction pump P. When the vacuum cup 25 is brought into contact with the recording paper R inside the paper feeding cassette 20 in consequence of the motion of the paper feeding plate 24, the attraction of the recording paper R by vacuum is completed (Step S3). In this case, the contact of the vacuum cup 25 with the recording paper Rcauses the leading end of the recording paper to bend and enter an empty space 9 inside the paper feeding cassette 20 and consequently ensures the fastness of adhesion of the vacuum cup 25 to the recording paper R. The completion of this attraction by vacuum is detected by the sensor (not shown) perceiving the fact that the paper feeding plate 24 has assumed the position of its lower reach. This state is depicted in FIG. 8A.

Then, Step S4 is executed to shake the paper feeding plate 24 in the reverse direction and raise the vacuum cup 25. During this rise of the vacuum cup 25, the plurality of cohering recording papers are perfectly separated asunder because the leading end of the recording paper R collides with the outer peripheral surface of the pressing roller 29 which is rotating in the counterclockwise direction in the bearings shown in the diagram. Even when a plurality of recording papers R are accidentally attracted by the vacuum cup 25, the cohering recording papers except for the uppermost one directly adhering to the vacuum cup are separated asunder and caused to fall because the leading ends of the recording papers R during their rise collide with the outer peripheral surface of the pressing roller 29 and the pressing roller 29 is rotating in the direction in which the outer peripheral surface thereof causes the recording papers to fall.

Figure 8B:
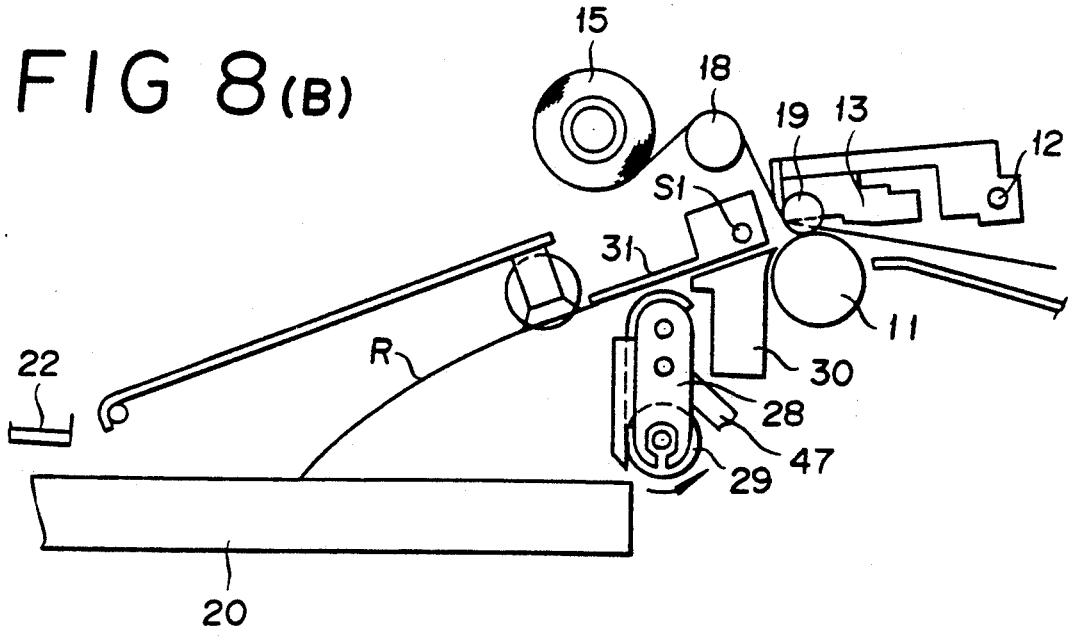

FIG. 8B illustrates the state which the vacuum cup 25 assumes when it has moved to its upper reach. The recording paper R is attracted by the vacuum cup 25 and the leading end part thereof is consequently raised. When the fact that the vacuum cup 25 has assumed the position of its upper reach is detected at Step S5, a timer t1 is started at Step S6. The timer t1 serves the purpose of setting the time for keeping the pressing roller 29 waiting at the position indicated in FIG. 8B until the vacuum cup 25 having attracted the recording paper R and assumed the position of its upper reach moves the pressing roller 29 in the pressed state toward the rotary roller 26. Even when a plurality of recording papers R are attracted by the vacuum cup 25, the unnecessary recording papers conveyed during the waiting time mentioned above are separated asunder by being bent by virtue of the step D between the rotary roller 26 and the vacuum cup 25 as illustrated in FIG. 5A, with the result that these unnecessary recording papers are caused to fall toward the cassette 20 and the one normal recording paper R is allowed to remain attached fast to the vacuum cup 25.

Figure 8C:
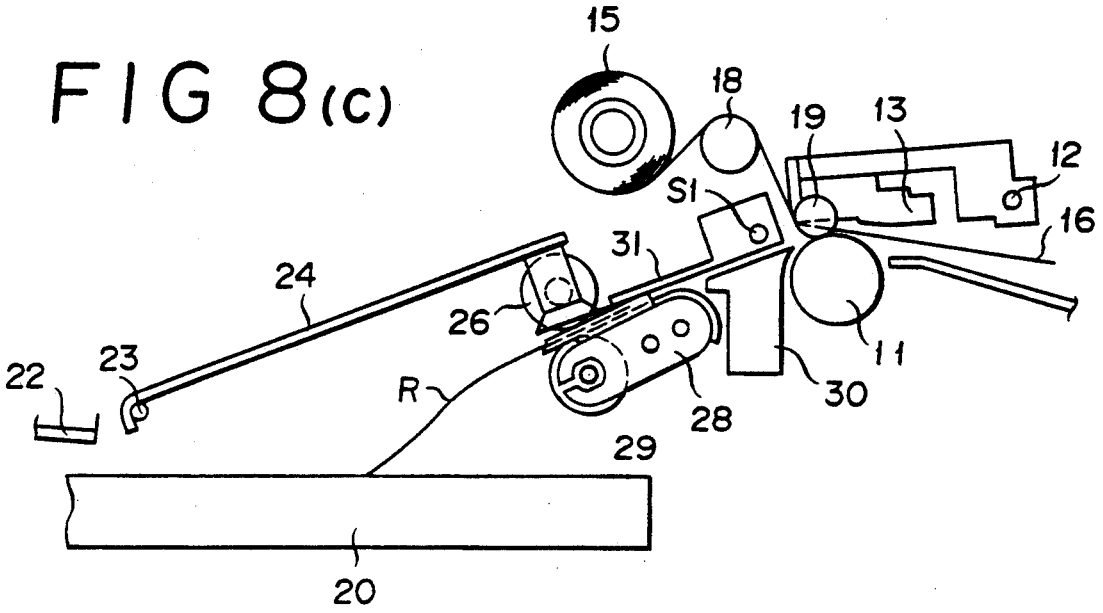

When the fact that the timer t1 has run out is detected at Step S7, the timer t1 is reset at Step S8 and the cam driving motor M3 is set into motion so as to rotate the roller holder 28 at Step S11. As a result, the cam 54 is rotated to the position of the slit Sb of the encoder 57. When this rotation is detected at Step S12, the motion of the cam driving motor M3 is stopped and, at the same time, the reverse motion of the conveying motor M2 is stopped at Step S13. At this time, the driving member 52 reaches the position 54*b* of the cam 54 and the pressing roller 29, as illustrated in FIG. 5A and FIG. 8C, comes to a stop as separated by a distance of about several mm from the rotary roller 26.

In the ensuant state, the suction pump P is stopped at Step S14 and the timer t2 starts clocking the time at Step S15. This timer t2 serves the purpose of regulating the interval between the time the attraction is ceased and the time the fall of the recording paper R under its own weight to the guide member 37 is completed. The recording paper R while falling is guided and located at the prescribed position by the tapering part 39*b* and the right angle part 39*a*. When the fact that the timer has run out is detected at Step S16, the timer t2 is reset at Step S17. FIG. 5B illustrates the state of the recorded paper P placed on top of the guiding part 37.

Figure 8D:
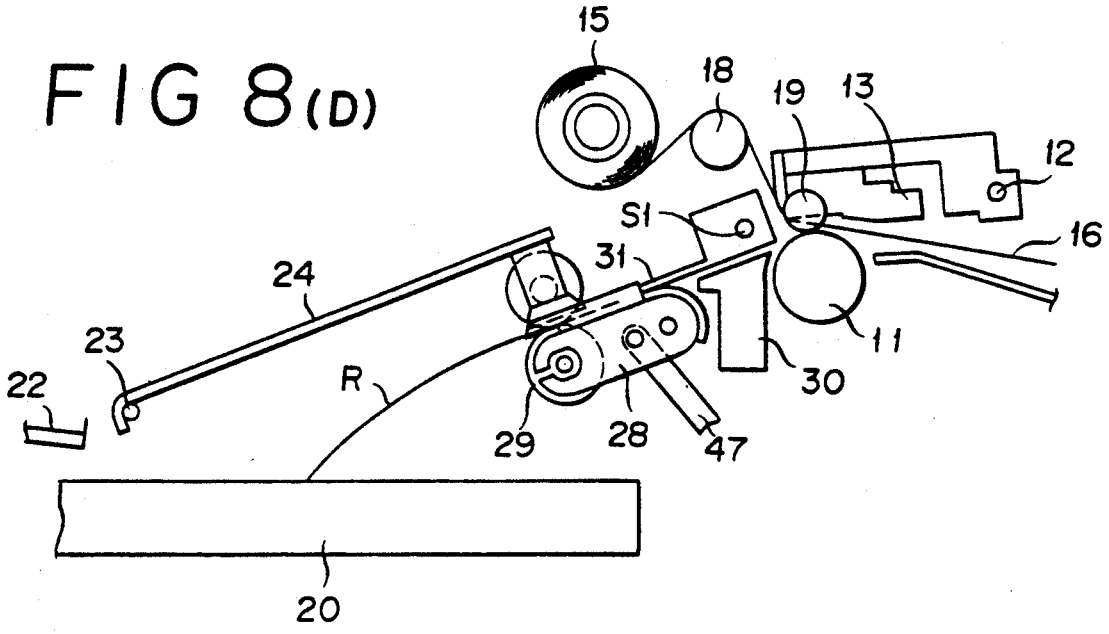

Again, the cam driving motor M3 is started at Step S18. When the fact that the cam 54 has been rotated to the position of the slit Sc of the encoder 57 is detected at Step 19, the cam driving motor M3 is stopped at Step S20. As a result, the driving member 52 contacts the position 54*c* of the cam 54, the roller holder 28 is further shaken, and the pressing roller 29 contacts the rotary roller 26 through the medium of the recording paper R. This state is depicted in FIG. 5C and FIG. 8D. By starting the conveying motor M2 in this state and rotating the pressing roller 29 in the clockwise direction in the bearings shown in the diagram, the recording paper R is conveyed toward the image forming part.

Figure 9:
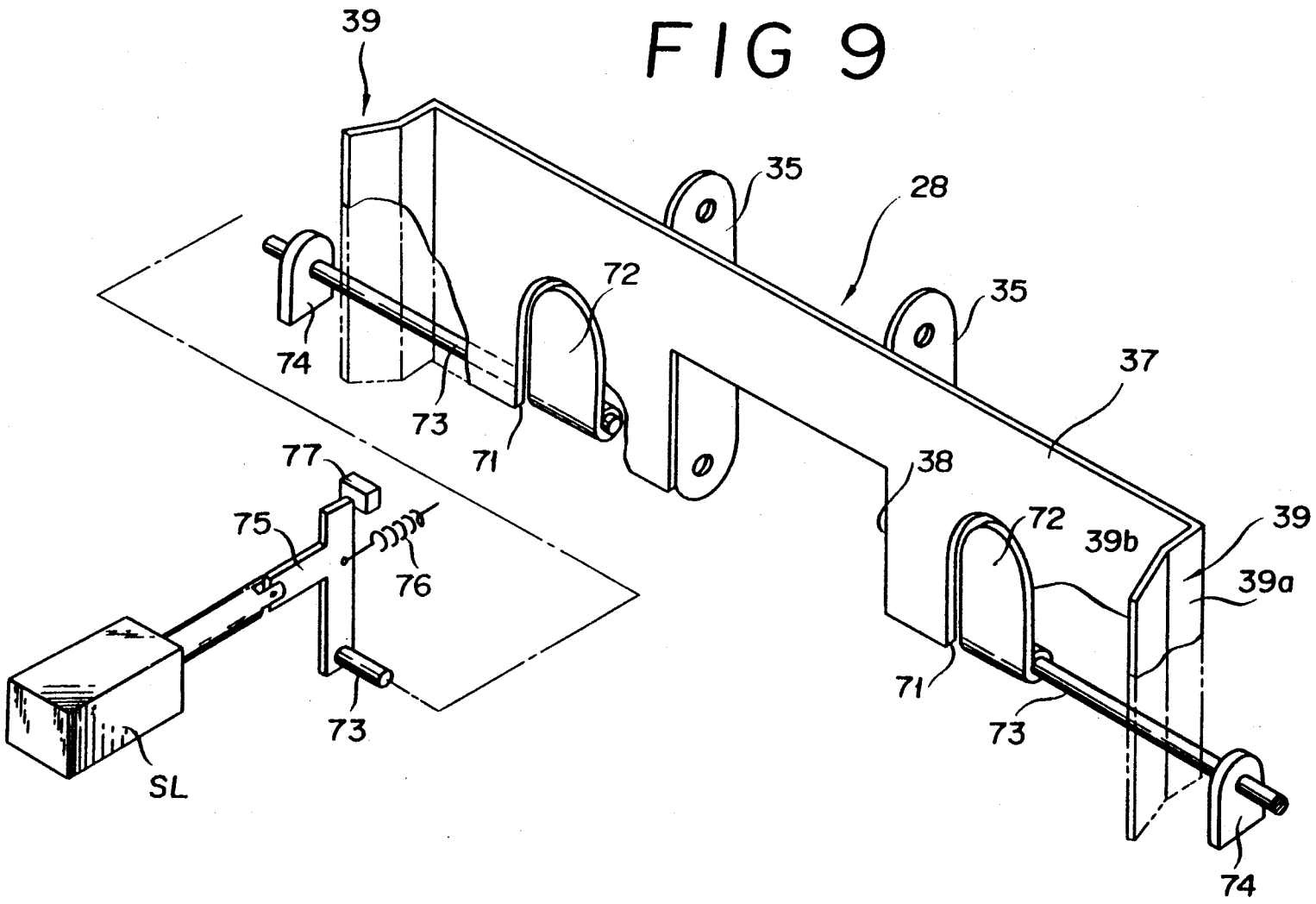
FIG. 9 is a partially omitted perspective view illustrating the guide plate of a roller holder of yet another type.

FIG. 9 is a diagram illustrating the guide plate 37 of the roller holder 28 in another embodiment of this invention. In the diagram, the pressing roller 29 and other similar parts are omitted. The operation of the roller holder 28 is illustrated in FIG. 10.

Two cutaway parts 71 are additionally formed one each along the opposite sides of the cutaway part 38 formed in the guide plate 37. When the guide plate 37 remains at the waiting position as illustrated in FIG. 8B, separating levers 72 are located at the positions at which they substantially fit into the positions of the cutaway parts 71. These separating levers 72 are fixed respectively on driving shafts 73. These driving shafts 73 are rotatably supported by bearing members 74 set in place inside the housing 10. To rotate the driving shafts 73 through the medium of a driving member 75, a solenoid S1 is connected to the driving member 75 and a spring member 76 is attached to the remaining side of the solenoid S1. When the separating lever 72 is retained in the position of retraction as illustrated in FIG. 9 and FIG. 10 and the solenoid S1 is energized, the driving shaft 73 is rotated through the medium of the driving member in spite of the resilient force of a spring member 76 and the separating lever 72 is caused to assume the separated position illustrated in FIG. 10B. The unnecessary recording papers R1 which have been conveyed in a cohering state, separated asunder, and caused to fall are returned by the separating levers 72 without fail even when their leading ends collide with the pressing roller 29. When the solenoid S1 is deenergized, the driving member 75 contacts a stopper 77 and the separating lever 72 returns to the position of retraction illustrated in FIG. 9.

The operation of the solenoid S1 is controlled, as illustrated in FIG. 7, by the CPU 60 through the medium of the solenoid driving circuit 68.

Figure 10A:
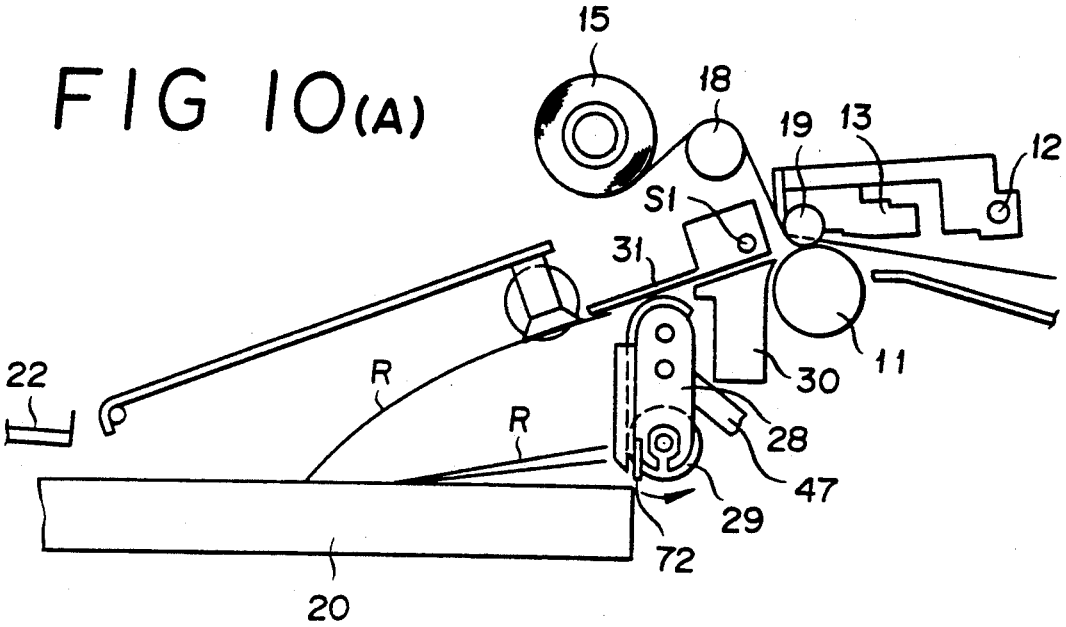
FIG. 10A and FIG. 10B are cross sections illustrating states of operation of the paper feeding device provided with the guide plate shown in FIG. 9.
Figure 10B:
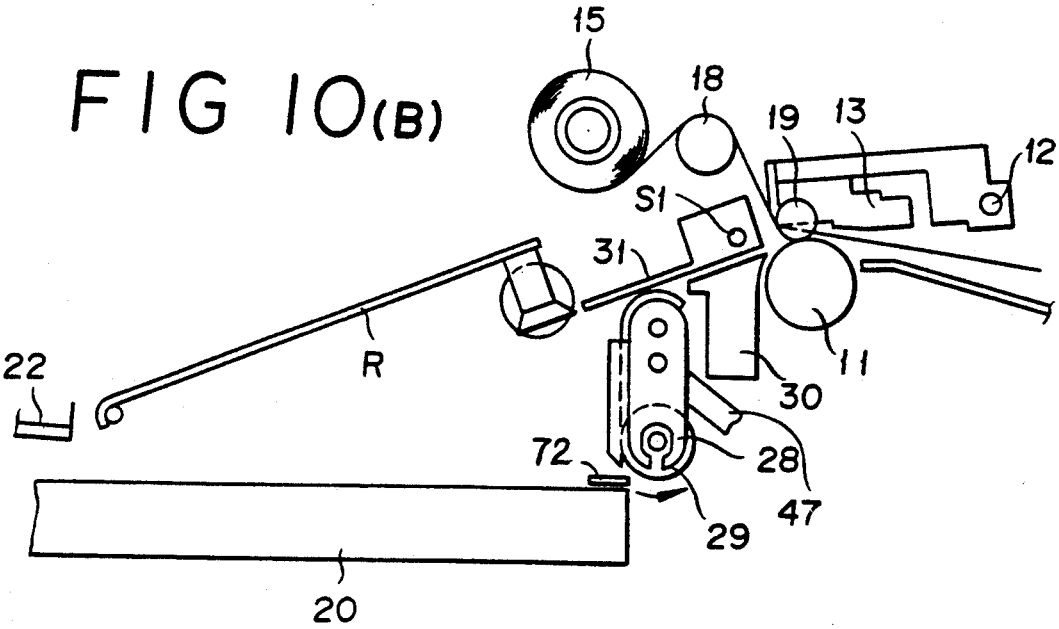
Figure 13:
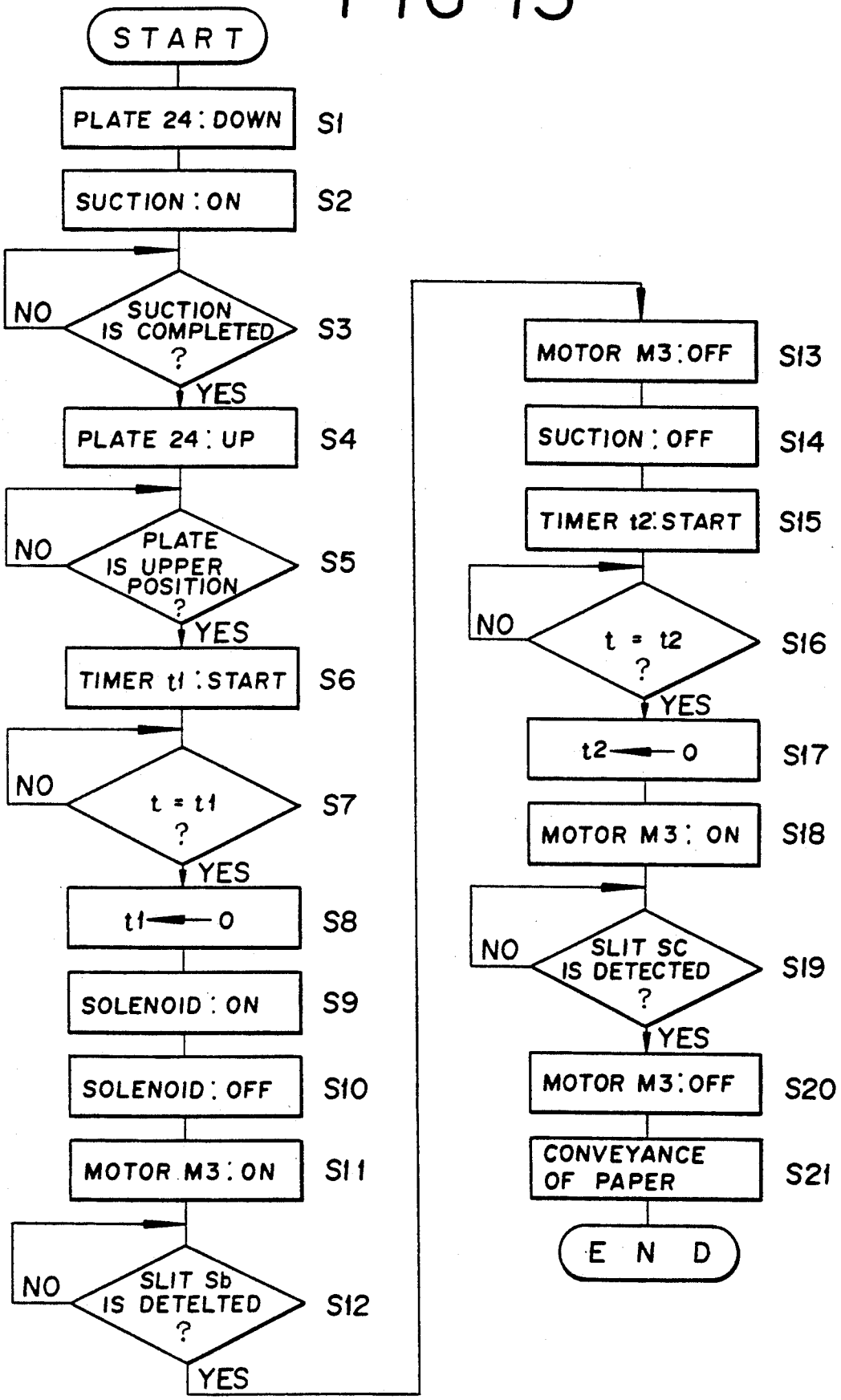
FIG. 13 is a flow chart representing the procedure of paper feeding followed by the paper feeding device illustrated in FIG. 9 and FIG. 10.

The paper feeding device provided with the guide plate 37 illustrated in FIG. 9 is operated as illustrated in the flow chart of FIG. 13 and in FIG. 10. To be specific, FIG. 10A corresponds to FIG. 8B and illustrates the the pressing roller 29 kept in the waiting state. At Step S9 in the diagram of FIG. 13, the solenoid S1 is turned on and the separating lever 72, as illustrated in FIG. 10B, is set into rotation after the waiting time is counted up at Step S8. As a result, the recording papers RI which have fallen down are delivered downward by the separating lever 72. In the present embodiment, the procedure of the preceding embodiment is followed, excepting Step S9 and Step S10 are added to all the steps of the preceding embodiment illustrated in FIG. 12. At Step S2 in FIG. 13, unlike that of FIG. 12, the pressing roller 29 is not rotated in the reverse direction while it is kept in the waiting state. It may be adapted, when necessary, to be driven in the reverse direction in the same manner as in the preceding embodiment.

Figure 14:
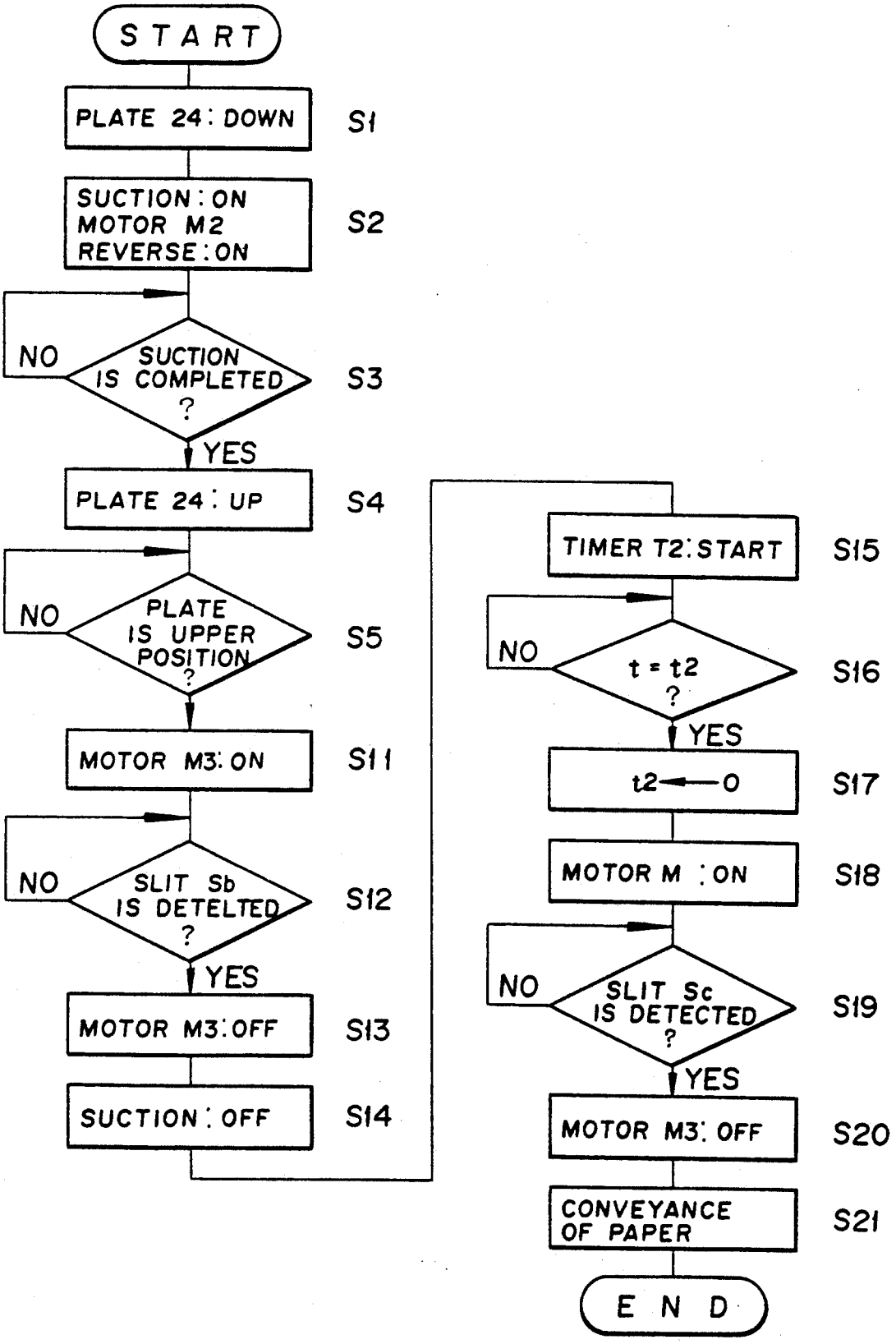
FIG. 14 is a flow chart representing the procedure of paper feeding followed by the paper feeding device illustrated in FIG. 11.

FIG. 11 is a diagram illustrating the paper feeding device in yet another embodiment. The operating procedure of this device is illustrated in FIG. 14.

Figure 11A:
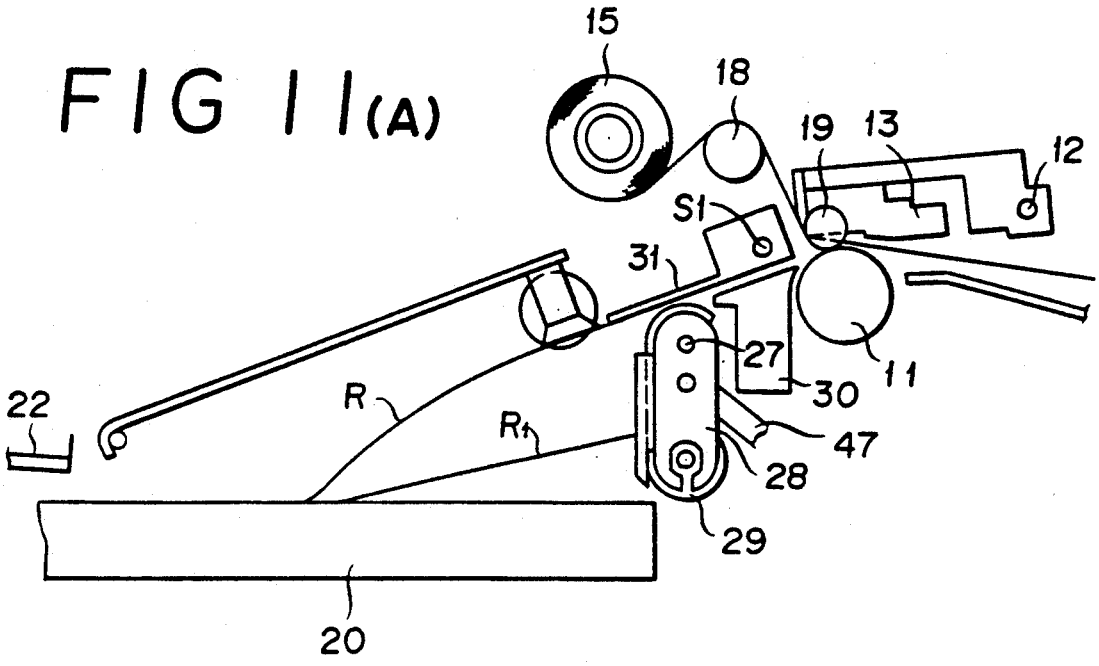
FIG. 11A and FIG. 11B are cross sections illustrating states of operation of the paper feeding device in another embodiment of the invention.
Figure 11B:
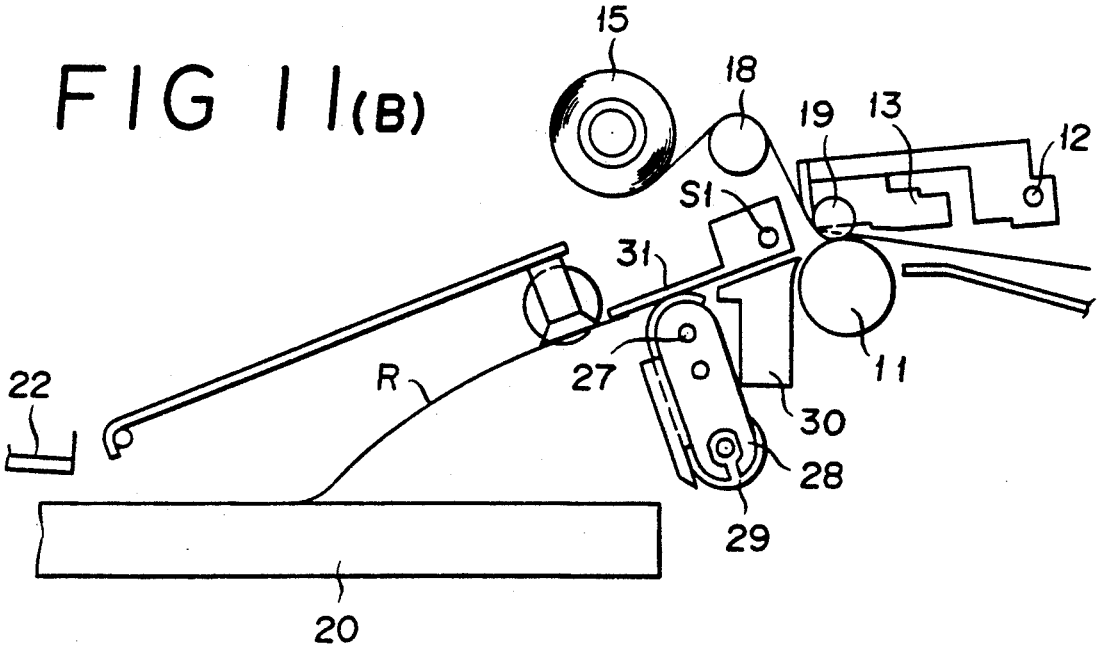

FIG. 11A illustrates an operating state corresponding to that of FIG. 8B in the first embodiment, i.e. the state of the vacuum cup 25 assuming the position of its upper reach. From this state, the roller holder 28 is first rotated in the counterclock direction in the bearings shown in the diagram, i.e. in the direction in which the pressing roller 29 retracts from the cassette 20, and then operated in the same manner as illustrated in FIG. 8C and FIG. 8D. As a result, the unnecessary recording papers R1 which have been conveyed in a cohering state as illustrated in FIG. 11A are not suffered to contact the pressing roller 29 but allowed to fall without fail while the pressing roller 29 is kept in the state of retraction. In the present embodiment, the procedure of the flow chart illustrated in FIG. 14 is effected, involving substantially the same steps as those of the embodiment illustrated in FIG. 13, excepting Steps S6 to S10 are omitted. Actually, however, since the roller holder 28 is disposed at the position illustrated in FIG. 11B, the cam used in this embodiment differs in shape from the cam 54 illustrated in FIG. 4. To be specific, the positions 54*b* and 54*c* of the cam 54 shown in FIG. 4 may be severally advanced by 90° and the cam position for enabling the roller holder 28 to be shaken to the position shown in FIG. 11B may be formed at the part of the position 54*b*, for example. In all the embodiments alike, the roller holder 28 and consequently the guide plate 37 are adapted to be left waiting for a prescribed time after the vacuum cup 25 has assumed the position of its upper reach as described above. In the procedure shown in FIG. 12, by reversing the rotation of the pressing roller 29 for the purpose of promoting the fall of the unnecessary recording papers which have been separated, there can be produced a motion for causing those unnecessary recording papers which have escaped separation in the process of rising and have been separated asunder at the position of upper reach to fall into the paper feeding cassette 20. In the embodiment illustrated in FIG. 13, the recording papers which are falling are conveyed further downward by the separating lever 72. In the embodiment illustrated in FIG. 14, the roller holder 28 is retracted from the position of the leading end of the recording paper.

FIG. 15 to FIG. 18 illustrate a paper feeding device in yet another embodiment. In this paper feeding device, the component members like those of the device illustrated in FIG. 1 are denoted by like reference numerals.

Figure 15:
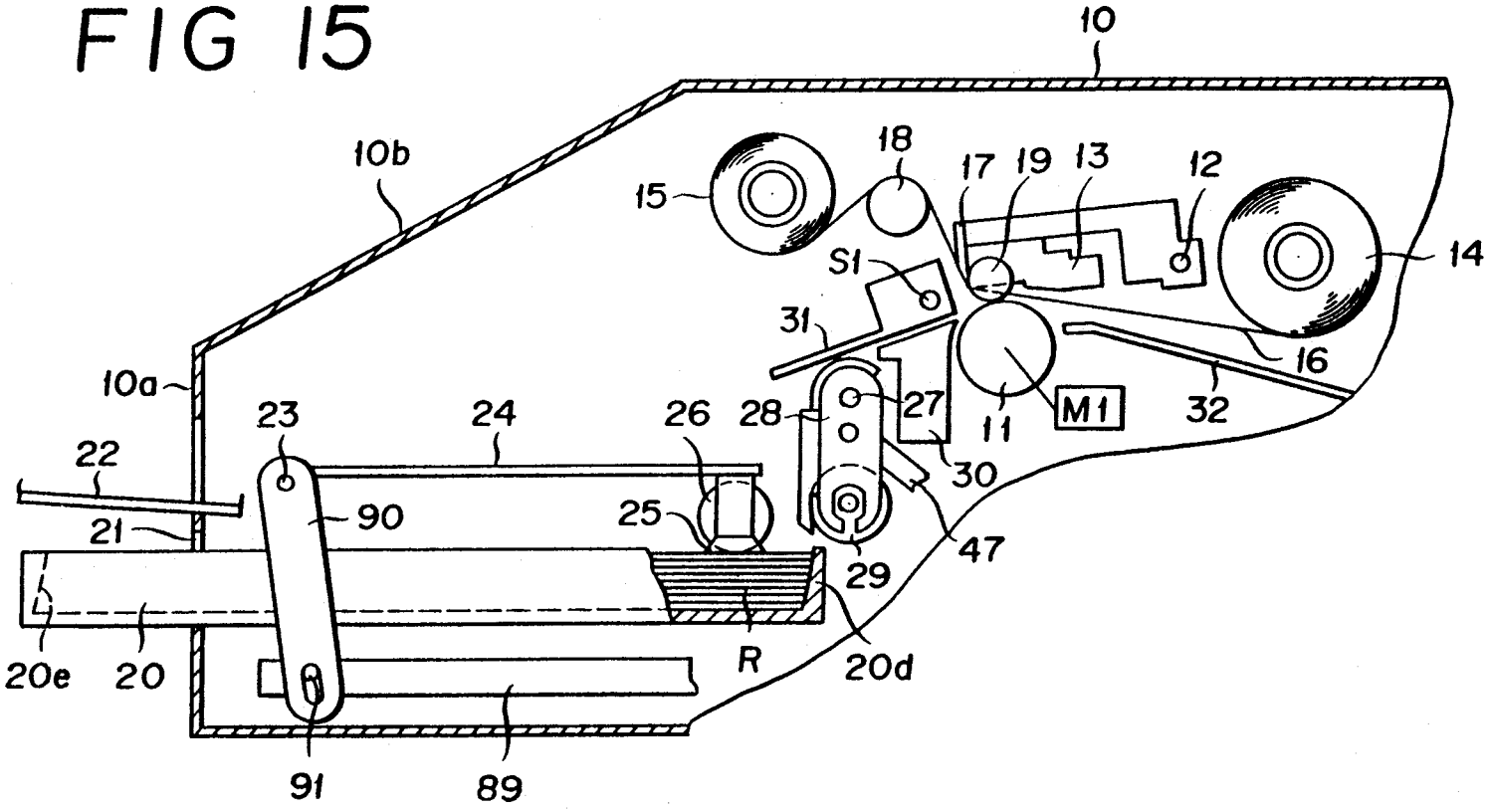
FIG. 15 is a lateral cross section illustrating the inner construction of a thermal ink transfer recording device as another embodiment of this invention.

In the paper feeding cassette 20, an arcuate surface 20*d* having a radius of curvature centering around the supporting pin 23 is formed on the inside of the leading end wall thereof and an arcuate surface 20*e* having a radius of curvature corresponding to that of the arcuate surface 20*d* is formed on the inside of the rear end wall as illustrated in FIG. 15. Owing to this setup, the extraction of the recording paper R from the paper feeding cassette 20 is smoothed by precluding the entanglement which otherwise occurs between the recording paper R and the leading end wall of the paper feeding cassette 20 when the recording paper R is played out from the paper feeding cassette 20. These arcuate surfaces 20*d* and 20*e* may be substituted with rectilinear surfaces which are inclined gradually upward to the right in the bearings shown in the diagram. It is otherwise permissible to have an empty space 9 formed in the bottom wall of the paper feeding cassette 20 as illustrated in FIG. 15.

In the paper feeding device illustrated in FIG. 15 unlike that illustrated in FIG. 1, the rotary roller 26 is rotatably attached to the leading end of the paper feeding device 24.

Figure 16A:
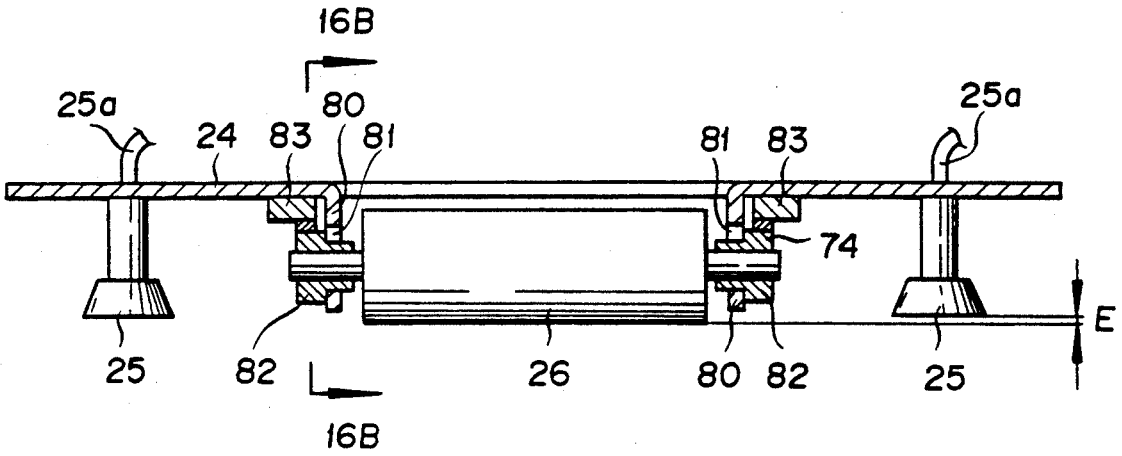
FIG. 16A is a cross section illustrating the leading end part of a paper feeding plate to which the rotary roller and the vacuum cup shown in FIG. 15 are attached.
Figure 16B:
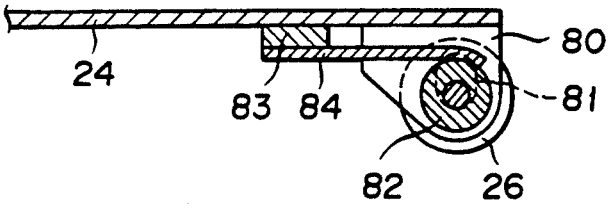
FIG. 16B is a cross section taken through FIG. 16A along the line 16B—16B.

The construction of the leading end part of this paper feeding device 24 is illustrated in FIG. 16A and FIG. 16B. The paper feeding device 24, as illustrated, is provided with brackets 80 for supporting the rotary roller 26. In the brackets 80, oblong holes 81 extending perpendicularly to the paper feeding plate 24 are formed one each. Bearings 82 for supporting the rotary roller 26 are freely movable in the oblong holes 81. Leaf springs 84 are set in place one each between spacers 83 disposed on the underside of the paper feeding plate 24 and the bearings 82. The leaf springs 84 with their resilient force urge the rotary roller 26 downward. While the rotary roller 26 is kept depressed downward by this resilient force, the lower side of the outer peripheral surface of the rotary roller 26 protrudes by the size of the step E past the lower surface of the aforementioned vacuum cup 25. In the illustrated construction, this step E is given a size of about 1 mm.

The detailed construction of the roller holder 28 illustrated in FIG. 15 is identical to that in the embodiment illustrated in FIG. 2 and FIG. 6.

Figure 17:
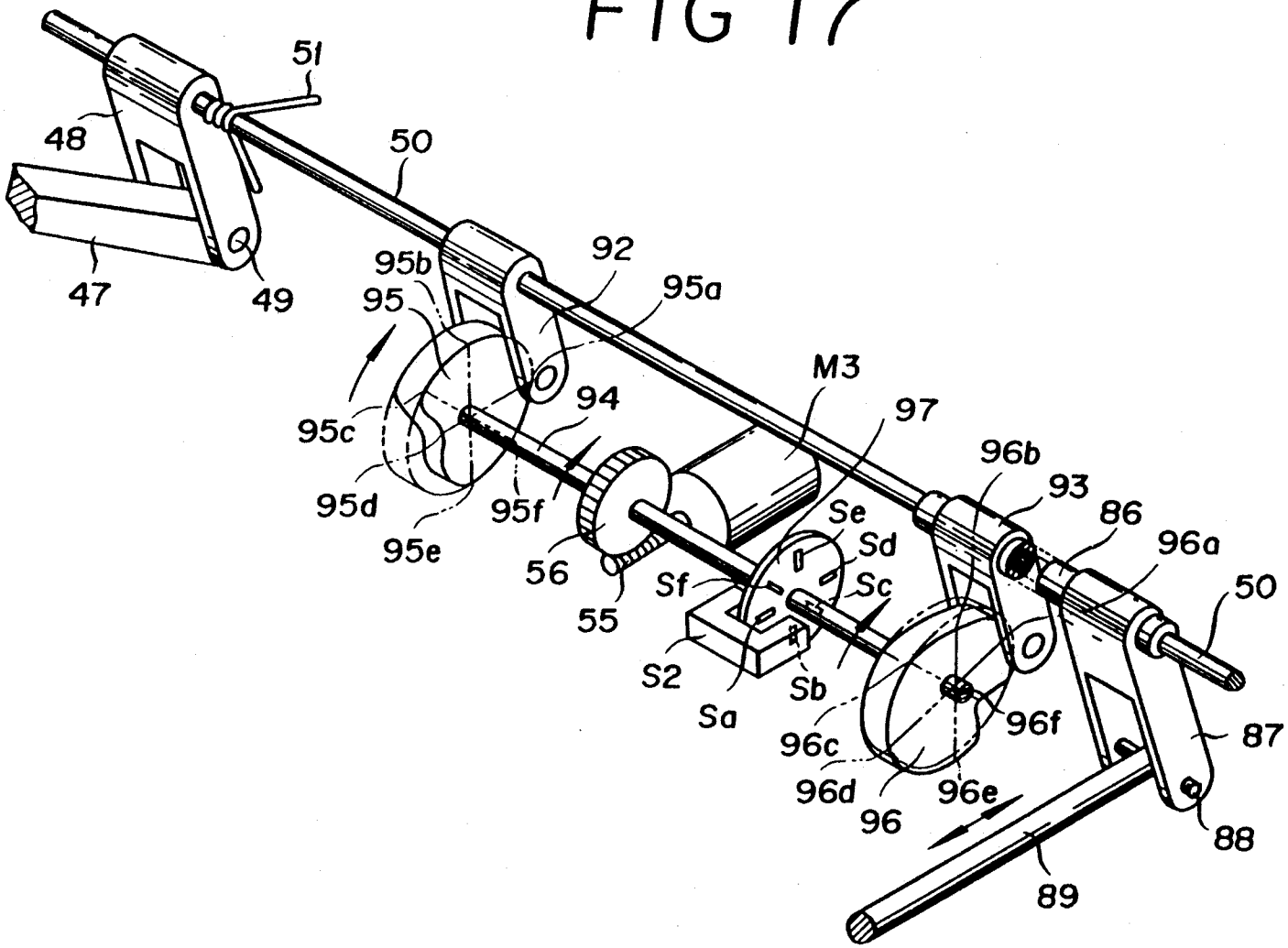
FIG. 17 is a perspective view illustrating a driving mechanism for shaking the roller holder and the paper feeding plate.

FIG. 17 is a diagram illustrating the driving mechanism for shaking the roller holder 28 and the paper feeding plate 24. The supporting shaft 50 is rotatably set in place inside the housing 10. The connection between the supporting shaft 50 and the roller holder 28 is attained by the same construction as that illustrated in FIG. 3 and FIG. 4. A sleeve 86 is rotatably fitted on the outside of the supporting shaft 50 as illustrated in FIG. 17. A shaking member 87 is fixed on the sleeve 86 and a connecting rod 89 is connected with a pin 88 to the lower end part of the shaking member 87. The remaining end part of this connecting rod 89 is connected with a pin 91 to a link 90 formed integrally with the paper feeding plate 24. The paper feeding plate 26, therefore, exerts the load of its own weight in the clockwise direction in the bearings of FIG. 15 through the medium of the link 90 and the connecting rod 89 upon the shaking member 87.

A first driving member 92 is fixed on the supporting shaft 50 and a second driving member 93 is fixed on the sleeve 86. Optionally, two independing supporting shafts may be rotatably disposed coaxially and the shaking member 48 and the first driving member 92 connected to one of the supporting shafts and the shaking member 87 and the second driving member 93 to the other supporting shaft instead of interconnecting the shaking member 87 and the second driving member 92 by the use of the sleeve 86 which is freely rotatable around the supporting shaft 50. On a rotary shaft 94 which is adapted to rotate freely parallelly to the supporting shaft 50, a first cam 95 which the first driving member 92 contacts and a second cam 96 which the second driving member 93 contacts are severally fixed. To rotate these cams 95 and 96, the worm gear 55 attached to the main shaft of the cam driving motor M3 is meshed with the worm wheel 56 fixed on the rotary shaft 94. To allow detection of the angle of rotation of these cams 95 and 96, a disk or an encoder 97 is fixed on the rotary shaft 94 and six slits Sa to Sf are formed in this encoder 97. To effect detection of the positions of these slits, a rotary angle sensor S2 comprising a light emitting element and a light receiving element is disposed adjacently to the encoder 97.

Now, the operation of paper feeding by the use of the illustrated paper feeding device will be described below with reference to FIG. 18.

Figure 18A:
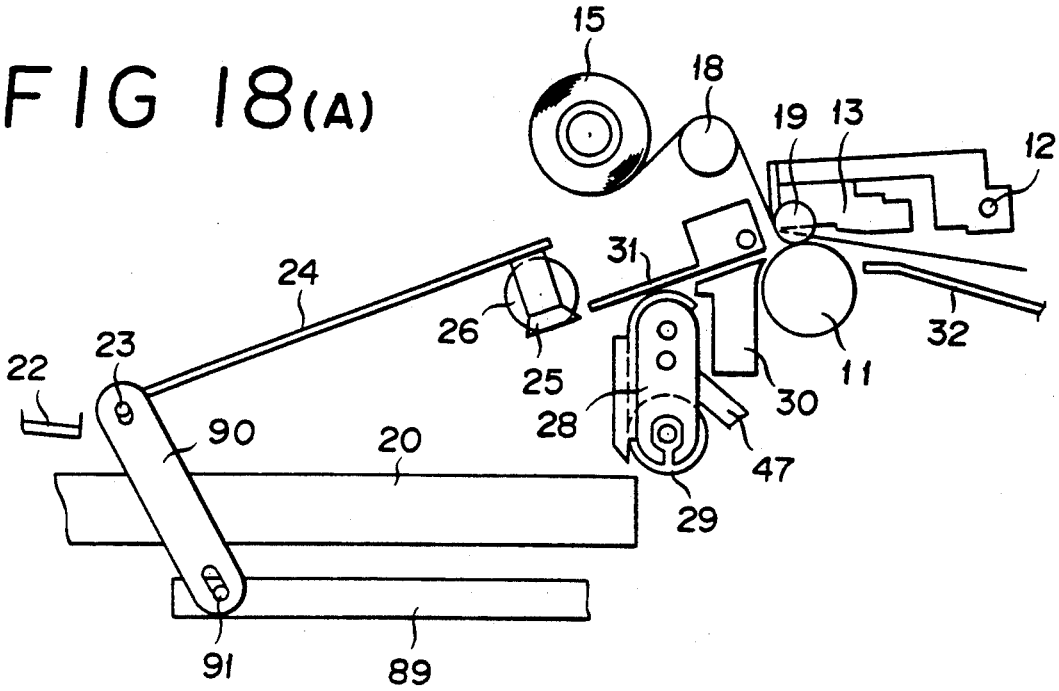
FIG. 18A to FIG. 18F are lateral cross sections illustrating a series of states of operation of the thermal ink transfer recording device shown in FIG. 15.

FIG. 18A is a diagram illustrating the state of the paper feeding device prepared for the operation of paper feeding. In this state, the slit Sa of the encoder 97 is located at the position of the angle sensor S2. At this time, the two cams 95 and 96 at their respective home positions 95*a*, 96*a* remain in contact with the driving members 92 and 93. As a result, the paper feeding plate 24 and the roller holder 28 are in the postures illustrated in FIG. 18A. The platen roller 11 in its initial state is parted from the thermal head 13.

In the following description, the conveyance of the recording paper R in the right in the bearings of the diagram will be referred to as "forward conveyance" and the direction of rotation of the motors M1 and M2 for the purpose of this forward conveyance as "normal rotation" and the reverse direction of rotation as "reverse rotation." The motor M3 is rotatable only in one direction.

Figure 18B:
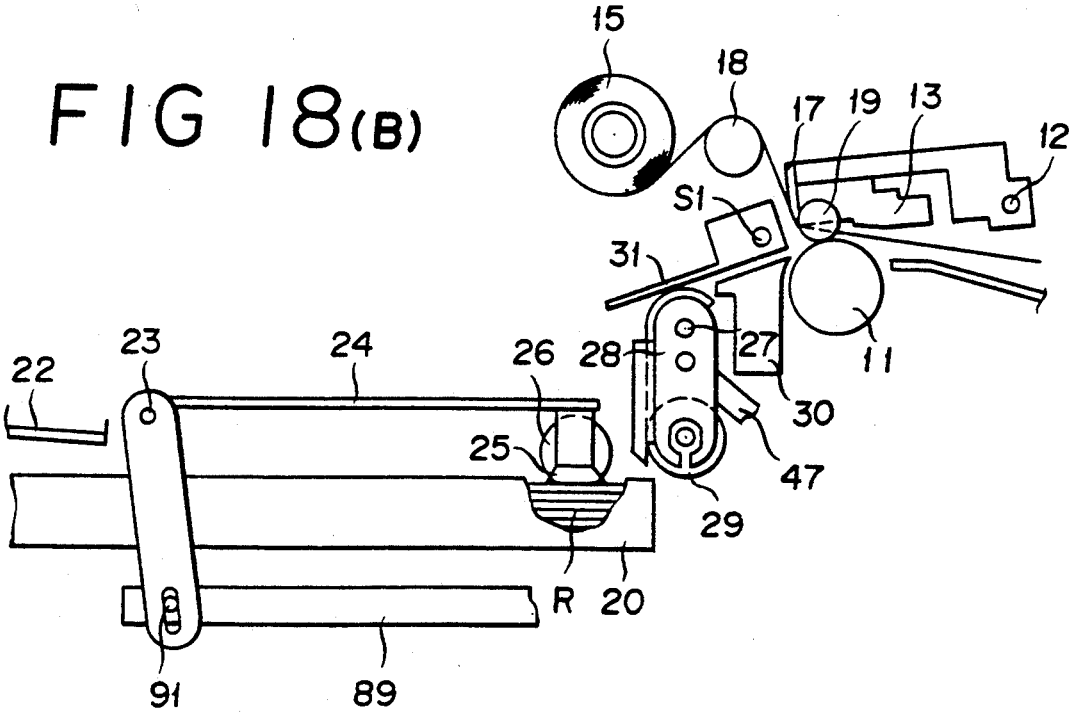

When the operation of paper feeding is started to reproduce an image on the recording paper R, the cam driving motor M3 is actuated and the two cams 95 and 96 and the encoder 97 are set into rotation in the direction indicated by an arrow in FIG. 17. When their rotations are continued until the position of the slit Sb of the encoder 97 reaches the position of the angle sensor S2, this fact is detected by the sensor S2 and the motor M3 is stopped. In the ensuant state, the two cams 95 and 96 respectively contact the driving members 92 and 93 at the cam positions 95*b* and 96*b*. The state of this contact is depicted in FIG. 18B. The vacuum cup 25 provided at the free end of the paper feeding plate 24 and the the rotary roller 26 jointly come into contact with the uppermost recording paper R inside the paper feeding cassette 20. The roll holder 28 is not shaken because the first driving member 92 is not rotated in conformity with the contour of the cam 95.

Figure 18C:
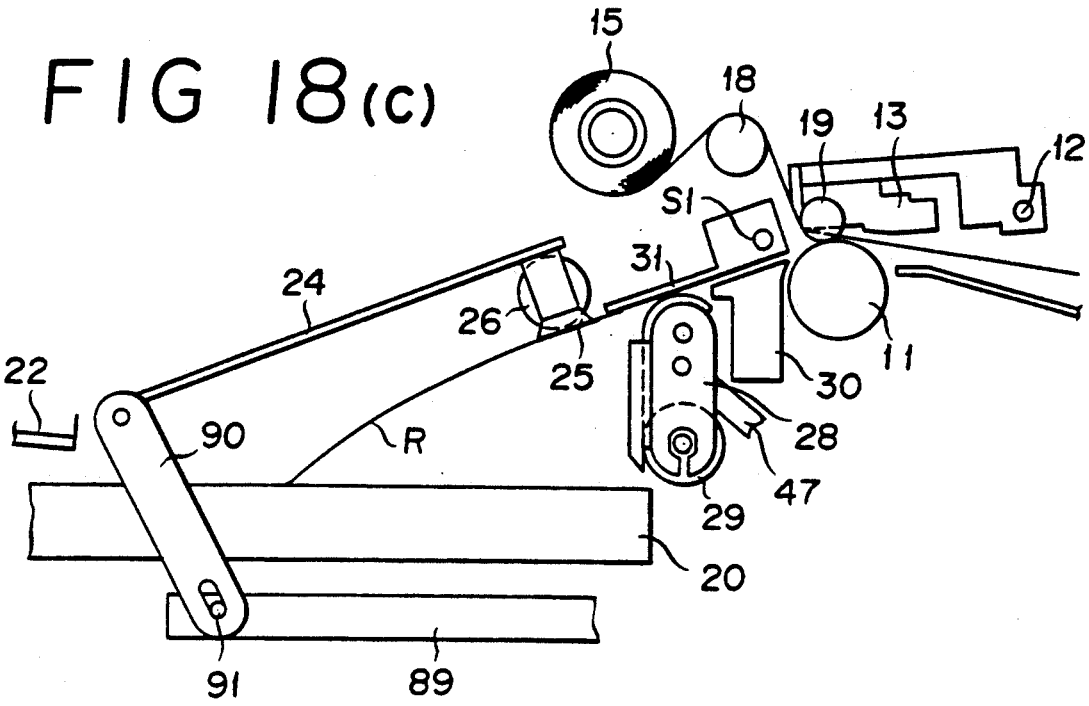
Figure 18D:
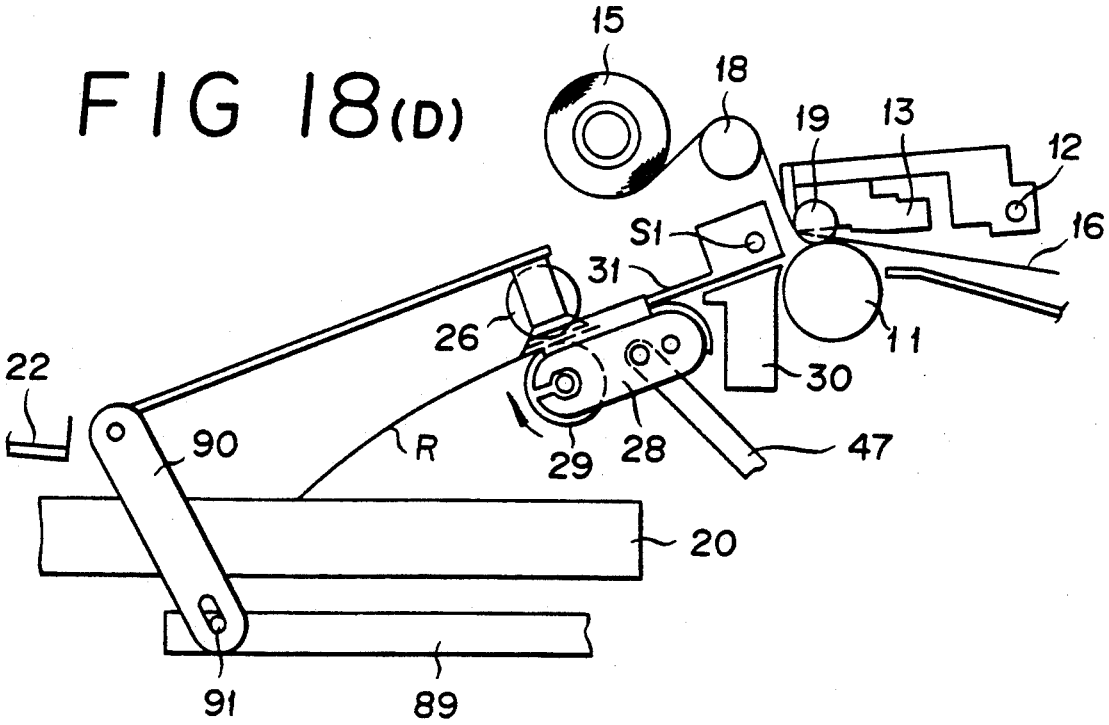
Figure 18E:
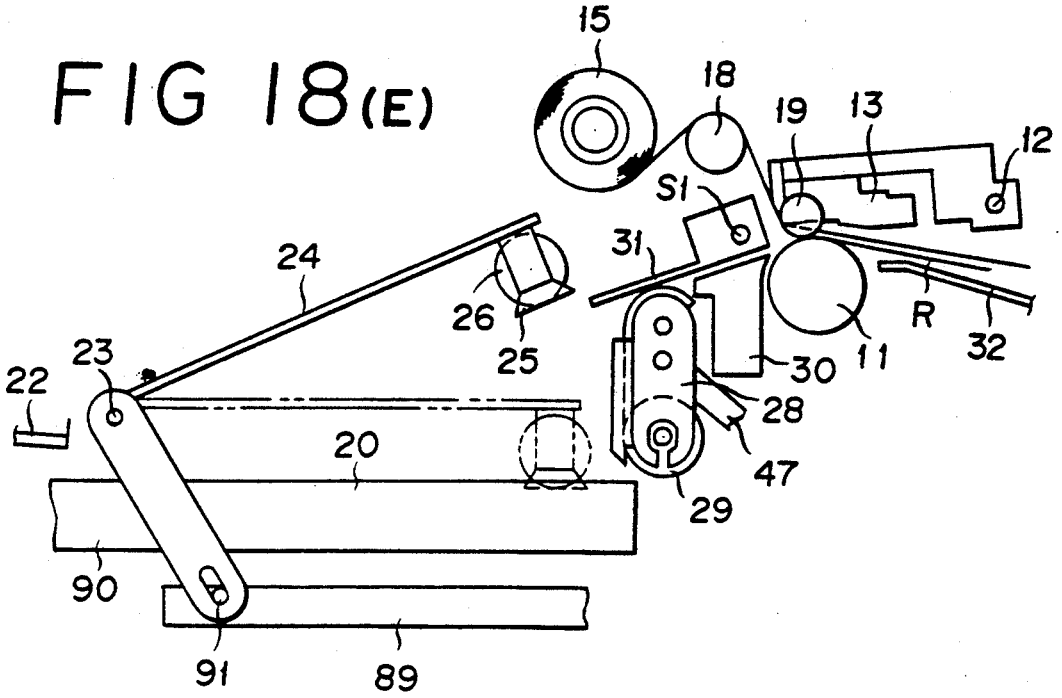

In the state illustrated in FIG. 18B, the vacuum cup 25 attracts the recording paper R by vacuum. Thereafter, the cam driving motor M3 is set into motion again to rotate the two cams 95 and 96. The cam driving motor M3 is stopped when the angle sensor S2 detects the slit Sc of the encoder 97. As a result, the paper feeding plate 24 is raised in conjunction with the rotary roller 26 to the prescribed position of conveyance as illustrated in FIG. 18C. By again setting the cam driving motor M3 into motion in the ensuant state, the cams 95 and 96 are rotated until the position of the slit Sd of the encoder 97 reaches the position of the sensor S2. As a result, the recording paper R is nipped by the cooperation of the rotary roller 26 and the pressing roller 29 as illustrated in FIG. 18D.

In the ensuant state, the conveying motor M2 is set into normal rotation and the pressing roller 29 is rotated in the clockwise direction to induce the forward conveyance of the recording paper R in the direction of the platen roller 11. When the recording paper R is consequently conveyed forward to the prescribed position of forward reach, it is moved backward by the platen roller 11 and, in the meantime, an image is formed on the recording paper R, with the rear end part of the recording paper R as the leading end thereof in the direction of printing. In this case, to prevent the recording paper R en route toward the paper feeding side from interfering with the rotary roller 26 and the pressing roller 29, the paper feeding plate 24 and the roller holder 28 are shaken to the positions illustrated in FIG. 18E in advance of the operation of image formation. The shaking to these positions is accomplished by restarting the cam driving motor M3. The motor M3 is stopped when the slit Se of the encoder reaches the position of the sensor S2.

Figure 18F:
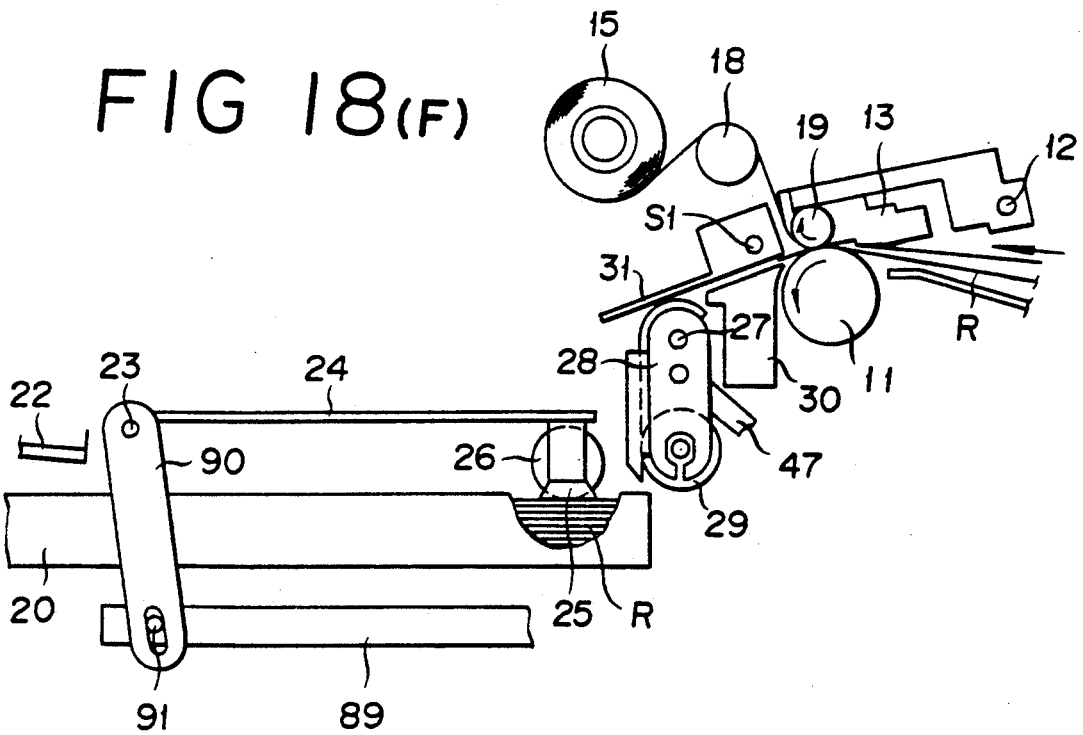

When the printing motion is produced in the existent state, the recording paper R which is returned in consequence of the printing motion enters a large space. Alternatively, the device may be modified so that the recording paper 24 retracts downward as indicated by a two-dot chain line in FIG. 18E. During the formation of the image with the last color, by driving the motor M3 until the slit Sf reaches the position of the sensor S2, the paper feeding plate 24 is lowered to the prescribed position as illustrated in FIG. 18F so as to prepare the device for the discharge of the recording paper R. As a result, the recording paper R is not suffered to collide with the rotary roller 26 even when the recording paper R is retracted in consequence of the printing motion. The discharge of the recording paper R into the paper discharge tray 22 is accomplished by the reverse rotation of the platen roller 11. Depending on the length of the recording paper R, a pair of rollers intended exclusively for paper discharge may be disposed near the paper discharge tray 22.

Figure 19A:
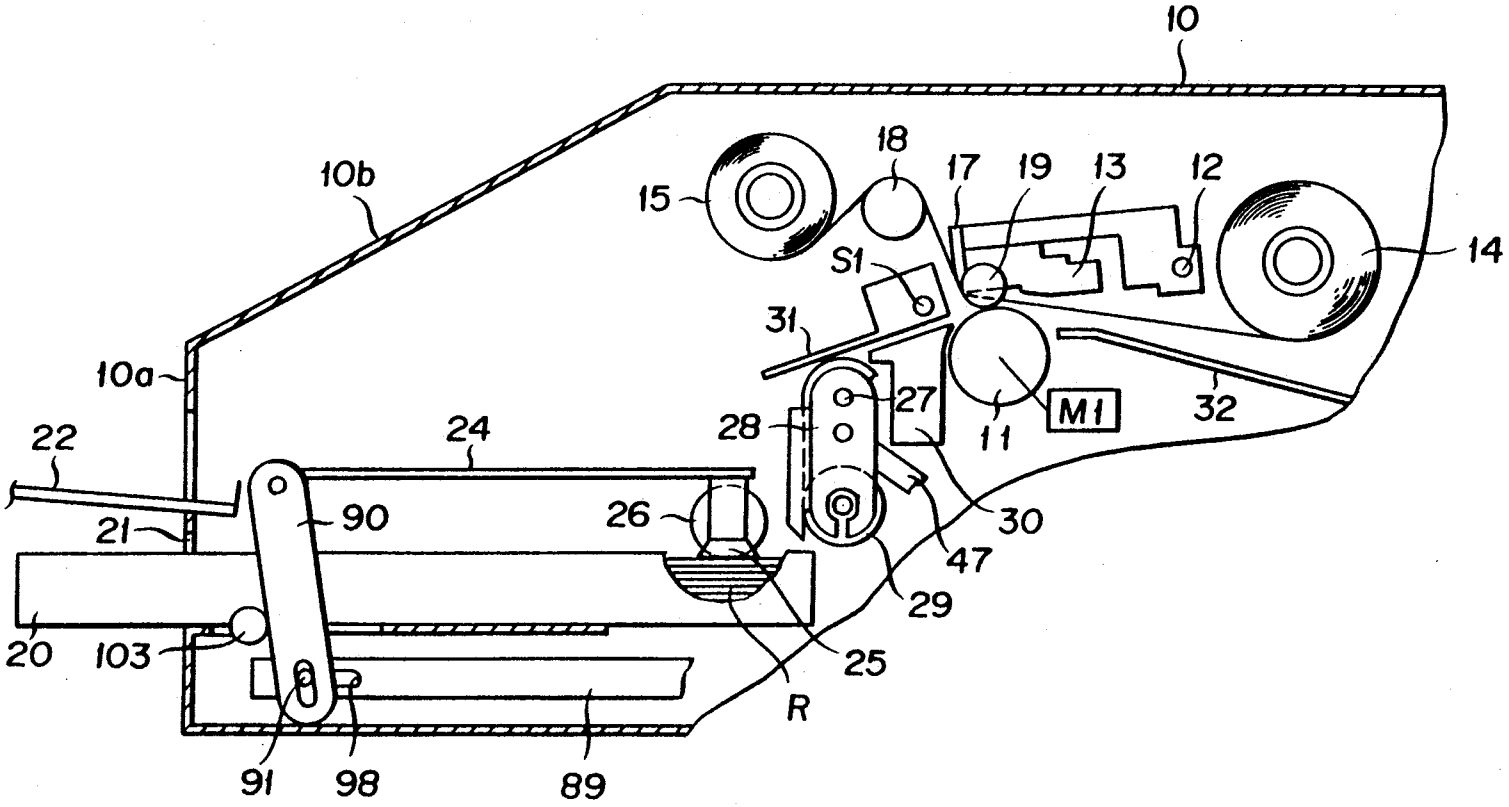
FIG. 19A and FIG. 19B are cross sections illustrating paper feeding devices as modifications.
Figure 19B:
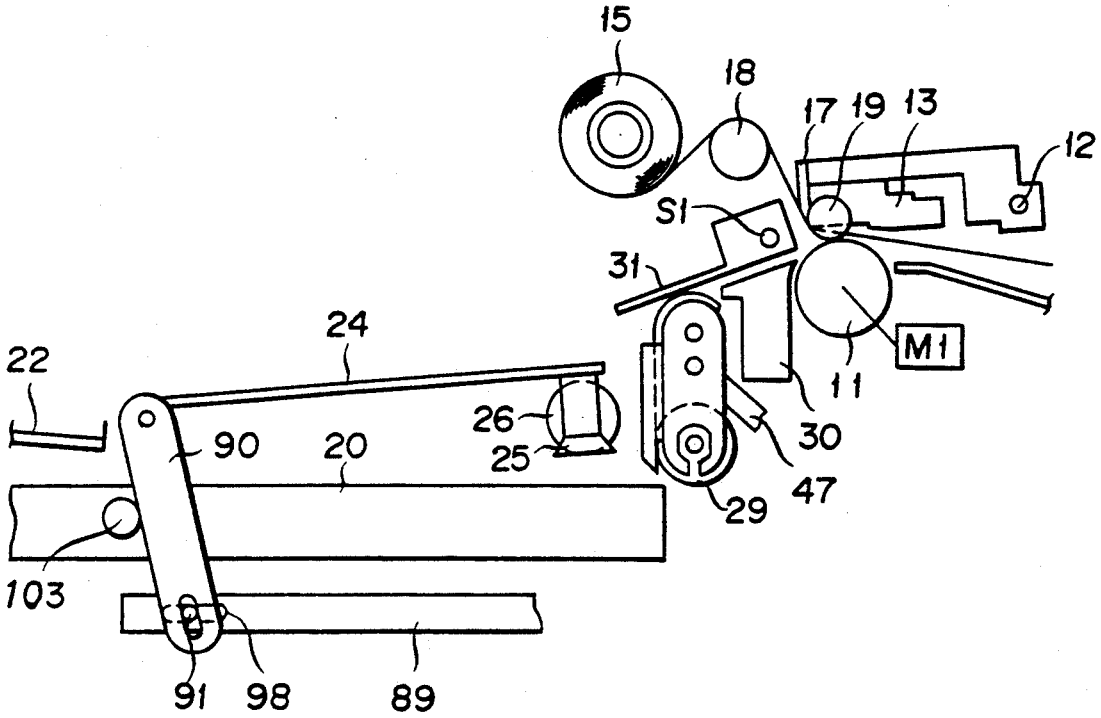
Figure 20:
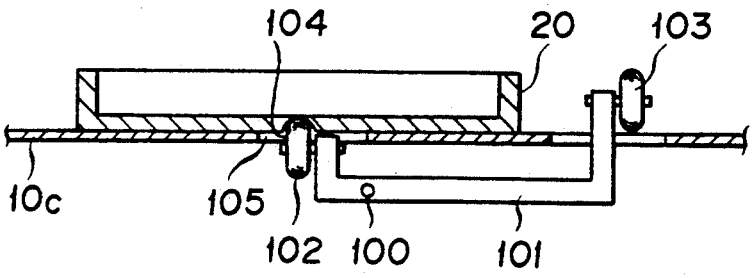
FIG. 20A and FIG. 20B are cross sections illustrating the essential part shown in FIG. 19.
Figure 20:
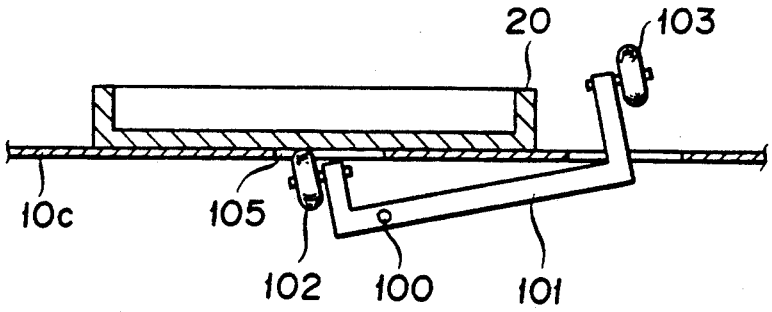

FIG. 19 and FIG. 20 are diagrams illustrating a paper feeding device as a modification of the embodiment of FIG. 15. In this embodiment, the vacuum cup 25 and the paper feeding cassette 20 are prevented from interfering with each other even when the paper feeding cassette 20 is taken out from the housing 10 while the paper feeding plate 24 is remaining at the home position. For the purpose of this prevention, a lever 101 which, by virtue of a supporting pin 100 facing the direction of charging the paper feeding cassette 20, is enabled to be shaken freely around the supporting pin 100 is disposed below the paper feeding cassette 20 and rollers 102 and 103 are rotatably attached to the opposite ends of the lever 101. The one roller 102, when the paper feeding cassette 20 has assumed the charging position, enters a depressed part 104 formed in the cassette 20 via a through hole 105 formed in the supporting plate 10c. At this time, the other roller 103 remains in contact with the link 90 which is held at the home position as illustrated in FIG. 19A. The connecting rod 89, as illustrated in FIG. 19A and FIG. 19B, has formed therein an oblong hole 98 in which the pin 91 for interconnecting the connecting rod 89 and the link 90 is allowed to slide.

When the paper feeding cassette 20 is extracted from the housing 10 as illustrated in FIG. 20B, therefore, the roller 102 is pushed out from the depressed part 104 and then lowered and the lever 101 is shaken in the counterclockwise direction in the bearings of FIG. 20. As a result, the other roller 103 is raised and the link 90, as illustrated in FIG. 19B, is shaken and rotated in the counterclockwise direction without reference to the position of the connecting rod 89.

The illustrated embodiments have been portrayed as the ones forming an image by transferring inks of three colors. When the formation of an image is carried out by the so-called face sequence method using an ink film 16 having inks of a plurality of colors applied thereto, this invention can be embodied with an ink film which has inks of six colors including, besides the aforementioned three colors, their intermediate colors applied thereto or an ink film which has an ink of black color applied thereto.

What is claimed is:

1. A paper feeding device, comprising:

a sheet holding part for accommodating sheets;

an attracting member for attracting the uppermost sheet of said accommodated sheets;

a first supporting member for supporting said attracting member so as to allow motion thereof to an attracting position and a feeding position, said attracting position representing a position at which said attracting member contacts with the uppermost of the sheets accommodated in said sheet holding part and said feeding position representing a position which lies above said attracting position;

a rotary member capable of moving between a first position at which said rotary member contacts with the leading end of said sheet attracted by said attracting member while the attracted sheets are moving from said attracting position to said feeding position by the first supporting member and a second position at which said rotary member contacts with the lower surface of said sheet having been moved to said feeding position by the first supporting member; and a second supporting member for rotatably supporting said rotary member and for moving the rotary member from the first position to the second position.

2. A paper feeding device according to claim 1, which further comprises driving means for setting said rotary member into rotation in the direction of delivering said sheet when said rotary member is located at said second position.

3. A paper feeding device according to claim 2, wherein said driving means rotates said rotary member in the direction of returning to said sheet holding part the leading end of said sheet being moved as attracted by said attracting member when said rotary member is located at said first position.

4. A paper feeding device according to claim 2, which further comprises a second rotary member disposed at a position at which said second rotary member contacts with the upper surface of said sheet located at said feeding position and confronts said rotary member located at said second position.

5. A paper feeding device according to claim 4, wherein said second rotary member is rotatably supported by said first supporting member.

6. A paper feeding device according to claim 4, wherein a plurality of said rotary members and said second rotary members are disposed at equal intervals in the direction perpendicular to the direction of conveyance.

7. A paper feeding device according to claim 1, which further comprises control means for controlling the rotary member and the attracting member so that said rotary member moves from said first position to said second position after said attracting member moves from said attracting position to said feeding position.

8. A paper feeding device according to claim 7, which further comprises separating means capable of being moved between a position at which said separating means is retracted from the leading end of said sheet attracted by said attracting means and moved from said attracting position to said feeding position and a position at which said separating means separates said sheet held in contact with said rotary member.

9. A paper feeding device according to claim 1, which further comprises a guide plate disposed on said second supporting member and adapted to guide the lower surface and the lateral end of said sheet located at said feeding position.

10. A paper feeding device according to claim 9, which further comprises control means for controlling said rotary member and said attracting member by sequentially performing a step of moving said attracting member from said attracting position to said feeding position when said rotary member is located at said first position, a step of moving said rotary member from said first position to a third position which is adjacent to the lower surface of said sheet at said feeding position between the first and second positions, a step of stopping said attracting member's operation of attracting said sheet when said rotary member located at said third position, and a step of moving said rotary member from said third position to said second position after the elapse of a prescribed time.

11. A paper feeding device according to claim 10, wherein said control means further controls the rotary member and attracting means so that said rotary member starts to move from said first position to said third position after said attracting member is moved from said attracting position to said feeding position.

12. A paper feeding device according to claim 1, wherein the sheet supporting surface of said sheet holding part has a depressed part formed at the position opposite the leading end part of said sheet.

13. A paper feeding device, comprising:

a sheet holding part for accommodating a stack of sheets;

an attracting member for attracting said sheets one at a time;

a first supporting member for supporting said attracting member so as to allow motion thereof between an attracting position at at which said attracting member contacts the uppermost of said sheets held in said sheet holding part and attracts said uppermost sheet and a feeding position which lies above said attracting position and at which said sheet is delivered to the next step:

a first roller capable of motion between a first position at which said first roller contacts with the leading end of said sheet attracted by said attracting member and moved from said attracting position to said feeding position and a second position at which said first roller contacts with the lower surface of said sheet already moved to said feeding position;

a second supporting member for supporting said first roller rotatably:

a second roller disposed at a position at which said second roller contacts with the upper surface of said sheet located at said feeding position and confronts said first roller located at said second position: and drive means for rotating said first roller in the direction of returning to said sheet holding part said sheet moved by said attracting member when said first roller is located at said first position and for rotating said first roller in the direction of delivering said sheet to the next step when said first roller is located at said second position.

14. A paper feeding device according to claim 13, wherein said second roller is rotatably supported by said first supporting member.

15. A paper feeding device according to claim 14, wherein said attracting member supported by said first and second supporting members and said first and second rollers are moved to positions clear of contact with the sheet being fed out after said sheet has been sent out of said feeding position.

* * * * *

UNITED STATES PATENT AND TRADEMARK OFFICE

CERTIFICATE OF CORRECTION

PATENT NO. : 5,207,415

DATED : May 4, 1993

INVENTOR(S) : Junichi Yamamoto, et al.

It is certified that error appears in the above-identified patent and that said Letters Patent is hereby corrected as shown below:

In col. 3, line 24, change "prospective" to --perspective--.

In col. 4, line 26, change "link" to --ink--.

In col. 6, line 29, change "conveyomg" to --conveying--.

In col. 10, line 12, delete "the" (second occurence).

In col. 10, line 35, change "counterclock" to --counterclockwise--.

In col. 12, line 61, delete "the" (fourth occurrence).

In col. 16, line 14 (claim 13, line 8), delete "at" (second occurrence).

Signed and Sealed this

Twenty-fifth Day of January, 1994

Bruce Lehman

*Attest:*

BRUCE LEHMAN

*Attesting Officer*

*Commissioner of Patents and Trademarks*